US007721578B2

(12) United States Patent
Enoki et al.

(10) Patent No.: US 7,721,578 B2
(45) Date of Patent: May 25, 2010

(54) OPENING CURLED PORTION OF METAL CAN AND FORMING METHOD THEREOF

(75) Inventors: Yasushi Enoki, Sagamihara (JP); Toshio Matsuo, Sagamihara (JP)

(73) Assignee: Daiwa Can Company, Tokyo (JP)

( * ) Notice: Subject to any disclaimer, the term of this patent is extended or adjusted under 35 U.S.C. 154(b) by 9 days.

(21) Appl. No.: 12/241,412

(22) Filed: Sep. 30, 2008

(65) Prior Publication Data

US 2009/0035096 A1 Feb. 5, 2009

Related U.S. Application Data

(62) Division of application No. 10/512,992, filed as application No. PCT/JP03/05433 on Apr. 28, 2003, now Pat. No. 7,497,350.

(30) Foreign Application Priority Data

| | | |
|---|---|---|
| Apr. 30, 2002 | (JP) | 2002-127869 |
| Sep. 12, 2002 | (JP) | 2002-266714 |
| Jan. 27, 2003 | (JP) | 2003-017021 |
| Mar. 17, 2003 | (JP) | 2003-072267 |

(51) Int. Cl.
*B21B 1/00* (2006.01)
*B21D 11/20* (2006.01)
*B21D 51/24* (2006.01)

(52) U.S. Cl. ..... 72/101; 72/379.4; 72/125; 413/4

(58) Field of Classification Search ..... 72/86, 72/101, 125, 126, 67, 115, 82, 379.4; 413/4, 413/6, 71–74
See application file for complete search history.

(56) References Cited

U.S. PATENT DOCUMENTS

| | | | | |
|---|---|---|---|---|
| 2,157,896 | A | 5/1939 | Held | |
| 2,384,810 | A | 9/1945 | Calleson | |
| 3,478,921 | A | 11/1969 | Bartels | |
| 4,938,051 | A * | 7/1990 | Duffy et al. | 72/356 |

(Continued)

FOREIGN PATENT DOCUMENTS

| | | |
|---|---|---|
| EP | 1 247 750 A1 | 10/2002 |

(Continued)

*Primary Examiner*—Dana Ross
*Assistant Examiner*—Debra M Sullivan
(74) *Attorney, Agent, or Firm*—Oblon, Spivak, McClelland, Maier & Neustadt, L.L.P.

(57) ABSTRACT

A method for configuration of an outwardly curled portion formed on an opening portion of a metal can, in which both inner and outer faces of a metal sheet forming at least around the opening portion are covered with a resin film, in which the curled portion formed above an inclined face by curling an upper end of a trim end portion so as to confine it inside of the curled portion, as being squeezed in the can radius direction so as to contact a lower end thereof with the inclined face, and in which the metal sheet layers are folded in the can radius direction via the resin films except around both upper and lower ends of the curled portion. Accordingly, the trim end portion of in the curled portion can be prevented from getting rusty, and deterioration in the appearance of the curled portion can be avoided. Moreover, the strength of the curled portion is enhanced so that the resistance against the deformation is improved.

17 Claims, 16 Drawing Sheets

U.S. PATENT DOCUMENTS

| | | | | |
|---|---|---|---|---|
| 5,072,605 | A * | 12/1991 | Imazu et al. | 72/46 |
| 5,718,352 | A | 2/1998 | Diekhoff et al. | |
| 6,119,890 | A | 9/2000 | Kawamata | |
| 6,499,329 | B1 * | 12/2002 | Enoki et al. | 72/348 |
| 6,959,830 | B1 | 11/2005 | Kanou et al. | |

FOREIGN PATENT DOCUMENTS

| | | |
|---|---|---|
| GB | 1 571 938 | 7/1980 |
| JP | 52-150183 | 12/1977 |
| JP | 56-24431 | 3/1981 |
| JP | 56-14051 | 4/1981 |
| JP | 61-51314 | 4/1986 |
| JP | 62-22945 | 2/1987 |
| JP | 6-7619 | 2/1994 |
| JP | 08-085582 | 4/1996 |
| JP | 10-509095 | 9/1998 |
| JP | 2000-191006 | 7/2000 |
| JP | 2001-213417 | 8/2001 |
| JP | 2001-233333 | 8/2001 |
| JP | 2002-225865 | 8/2002 |
| JP | 2003-040265 | 2/2003 |
| WO | 01 15829 | 3/2001 |
| WO | 01 23117 | 4/2001 |
| WO | WO 01/38185 A1 | 5/2001 |

* cited by examiner

OPENING CURLED PORTION OF METAL CAN AND FORMING METHOD THEREOF

The present application is a divisional application of U.S. application Ser. No. 10/512,992 filed Oct. 29, 2004, now pending, which claims priority based upon Japanese Patent Application No. 2002-127869, filed Apr. 30, 2002; Japanese Patent Application No. 2002-266714, filed Sep. 12, 2002; Japanese Patent Application No. 2003-017021, filed Jan. 27, 2003; and Japanese Patent Application No. 2003-072267, filed Mar. 17, 2003, the entire contents and disclosure of each of which is hereby incorporated by reference.

TECHNICAL FIELD

The present invention relates to a curled portion, which is formed at an opening portion of a metal can and curled outwardly and a method for forming such a curled portion, and more particularly, to a configuration of a curled portion of a metal can in which both faces of a metal sheet corresponding to at least the portion around an opening portion are coated with a resin film and a trim end of the opening portion is curled inside of the outwardly curled portion, and to a forming method of the outwardly curled portion in which the opening portion is folded outwardly over a predetermined length from the trim end, and then the trim end is curled inside of the curled portion by flanging and folding.

BACKGROUND ART

In recent years, a PET bottle has been increasingly used in the field of beverage containers. An opening portion of the PET bottle is sealed by screwing a pilfer-proof cap made of a synthetic resin onto a threaded neck portion, and is resealable by screwing the cap again onto the threaded neck portion, even after opened by turning the cap to the left.

On the other hand, a can for a canned product or a beverage container competing with the PET bottle is numerously suggested by e.g., Japanese Utility Model Laid-Open No. 56-24431, Japanese Utility Model Laid-Open No. 61-51314, Japanese Patent Laid-Open No. 10-509095 (corresponding to the international publication No. WO96/15865, and corresponding to U.S. Pat. No. 5,718,352), Japanese Patent Laid-Open No. 2000-191006, WO01/15829 (corresponding to U.S. Pat. No. 6,499,329), WO01/23117 (corresponding to U.S. Pat. No. 6,463,776), Japanese Patent Laid-Open No. 2001-213417 and so on. The can comprises a diametrically small threaded cylindrical neck portion having a reseal function with a threaded cap, an inclining shaped shoulder portion and a diametrically large cylindrical trunk portion.

In WO01/15829, there is disclosed a type of a bottle-shaped can (i.e., a three-piece type) in which a diametrically small cylindrical threaded neck portion, a domed shoulder portion, and a diametrically large cylindrical trunk portion are integrally shaped from an aluminum alloy sheet, and in which a threaded cap (i.e., a pilfer-proof cap) made of an aluminum alloy sheet is mounted detachably on a neck portion of a can body wherein a bottom end (or a bottom wall) made of the aluminum alloy sheet is fixed an end portion of the trunk portion by double seaming method. In Japanese Patent Laid-Open No. 2001-213417, moreover, there is disclosed a type of the bottle-shaped can (i.e., a two-piece type) in which a threaded cap made of an aluminum alloy sheet is mounted detachably on the neck portion of a can body, the diametrically small cylindrical threaded neck portion, a frusto-conical shoulder portion, the diametrically large cylindrical trunk portion and a domed bottom portion of which are integrally shaped from the aluminum alloy sheet. In Japan, those bottle-shaped cans have been used for many kinds of beverages in recent years, such as a beer, a low-malt beer, a Japanese sake, a sparkling wine, a fruit juice, various types of carbonated beverages, a green tea, an oolong tea, a black tea, a coffee and so on.

As compared to the transparent PET bottle, the bottle-shaped can has excellent gas barrier performance and light intercepting effect. Therefore, the bottle-shaped can is excellent in, e.g., quality preservation to prevent the deterioration of quality of the beverage filled and sealed therein during storage or in stores. Similarly to the PET bottle, moreover, the bottle-shaped can may be resealed with the cap unless a content of the can e.g., the beverage is completely consumed. Furthermore, after the beverage is consumed, the bottle-shaped can be easily collected and recycled through existing an aluminum can recycling system. Thus, in view of recycling, the bottle-shaped can is superior to the PET bottle which does not have its own recycling system. For these reasons, the bottle-shaped can is expected to be used as the container for many more beverages. Since these advantages of the bottle-shaped can are obtainable also from the bottle-shaped can made mainly of a steel sheet (at least the can body is made of steel), the bottle-shaped can made of steel sheet is expected to be available.

In the bottle-shaped can of this kind, the diametrically small cylindrical neck portion, the domed or frusto-conical shoulder portion and the diametrically large cylindrical trunk portion are integrally shaped from the metal sheet, and both inner and outer faces of those portions are coated with the resin film. Moreover, the curled portion is formed annularly along an upper end opening edge of the neck portion where the thread is formed on its peripheral wall.

If an inwardly curled portion is formed on the opening portion (i.e., the upper end portion of the neck portion) of the bottle-shaped can, the curled portion obstructs a flow of the beverage so that it is hard for a consumer to let the beverage come out smoothly, when he opens the can and drinks the content, i.e., the beverage. Moreover, in case of resealing the can by the cap with the content remained therein, a hygiene situation gets worse due to the beverage adhered to the curled portion. Furthermore, since the trim end of the curled portion is situated inside of the can, the trim end of the curled portion (i.e., a trim end face where the metal sheet is exposed) gets corroded due to the beverage filled in the can, unless the trim end of the curled portion is especially be coated.

For these reasons, the outwardly curled portion is basically adopted to the metal can having the curled portion.

In case of forming the outwardly curled portion at the opening portion of the can, in addition, it is known in the prior art (e.g., Japanese Published Examined Application No. 56-14051, Japanese Utility Model Laid-Open No. 56-24431, Japanese Utility Model Laid-Open No. 61-51314, Japanese Utility Model Laid-Open No. 62-22945 etc.) that the curled portion is formed by curling and confining the trim end inward of the curled portion.

Here, the outwardly curled portion as formed at the opening portion of the aforementioned bottle-shaped can should have enough strength to withstand great pressure applied from above when the can is sealed with the cap after filling the beverage therein. Also, since the final products filled with the beverages and sealed (i.e., canned beverages) subject to drop impact when they are on transportation or in storage, or on display in store in a carton case, the opening curled portion should have sufficient deformation resistance against such a drop impact. Specifically, if the curled portion is deformed due to its insufficient deformation resistance (or strength), the sealability cannot be maintained in adequate manner between a seal member and the curled portion. Inadequate sealability causes a leakage of the beverage from between the neck portion and an inner face of the cap, and the wet carton case and contaminated other cans lead to mold growth in the carton case and the surface of the can.

On the other hand, the pilfer-proof cap, which is mounted on the neck portion of the bottle-shaped can made of an aluminum alloy sheet used as a positive pressure can (i.e., a can, in which an internal pressure is higher than an atmospheric pressure), generally has on its an upper portion a plurality of small holes called "vent slit" in a circumferential direction for the purpose of gas ventilation when opening the bottle-shaped can. If the vent slits are not provided, the cap may be blown off by a gas pressure generated between the cap and the neck portion when the can is opened. For this reason, the vent slits are so provided as to remove the gas pressure.

The can is hermetically sealed with a seal member attached to a rear face of a top plate of the cap. However, the vent slits opened between the neck portion and the cap allows moisture in the air or water to get therethrough even after the can is sealed with the cap. Such moisture or dew condensation thereof due to a cooling of the can or an abrupt change of the temperature of outside may corrode the trim end (i.e., a trim end face where the metal sheet is exposed) of the curled portion at the upper end of the neck portion.

The corrosion of the trim end of the curled portion caused by the moisture is not so serious problem for an aluminum can. However, in case of a steel can, the trim end of the curled portion gathers rust (i.e., red-rust) so that the commercial value of the can may be deteriorated significantly. In order to avoid such disadvantage, it is necessary to prevent the water from adhering to the trim end of the curled portion.

To this end, it is conceivable to apply a coating treatment to the trim end (i.e., a trim end face where the metal sheet is exposed) of the curled portion with a liquid coating compound or a fused thermoplastic resin. When applying such a coating treatment to the trim end of the curled portion, however, problems are often caused such as a scattering of the liquid coating compound or a stringing of the resin. In order to avoid these problems, it is necessary to develop a new apparatus and a new technology.

As has been described already, on the other hand, in case of forming the outwardly curled portion at the opening portion of the can, the curled portion is formed such that the trim end of the curled portion is rolled in and confined. This is known in the art by, e.g., Japanese Published Examined Application No. 56-14051, Japanese Utility Model Laid-Open No. 56-24431 (ref. FIG. 6), Japanese Utility Model Laid-Open No. 61-51314 (ref. FIG. 6), Japanese Utility Model Laid-Open No. 62-22945 and so on. With the configuration of this curled portion, it is possible to prevent the external water from entering into spaces of the curled portion and adhering to the trim end of the curled portion. Therefore, it is effective in view of rust resistance of the trim end of the curled portion of the steel can.

In case of the aluminum can, there is no possibility that the commercial value is deteriorated due to the rust on the trim end of the curled portion, unlike the steel can. However, regardless of whether the can is made of aluminum or steel, when the end portion of the opening side of the can body made of the resin coated metal sheet is trimmed in the manufacturing process, the resin film at the trim end may partially get fluffed like strings and peeled. If the curled portion formed on the opening portion is curled outwardly in this case, the fluffed and peeled resin film can be seen from outside at the lower end of the curled portion, thereby deteriorating an appearance of the can. Accordingly, it is preferable to form the outwardly curled portion by curling the trim end inside of the curled portion.

However, the known configuration of the curled portion thus formed, e.g., the configuration disclosed in Japanese Published Examined Application No. 56-14051, Japanese Utility Model Laid-Open No. 56-24431 (ref. FIG. 6), does not seem to have sufficient deformation resistance in view of strength. The curled portion may be deformed when it receives the great pressure from above or experiences the drop impact. As a result of this, the sealability between the curled portion and the cap (or a seal member) may be deteriorated.

On the other hand, according to the configuration as disclosed in, e.g., Japanese Utility Model Laid-Open No. 61-51314 (ref. FIG. 6) and Japanese Utility Model Laid-Open No. 62-22945, an upper end of the neck portion is curled doubly, after a threaded cylindrical body made of resin is fit into the neck portion, therefore, it seems excellent in strength. However, if the curled portion is not constantly pressed hard against the resin cylindrical body, the curled portion may slack due to springback, and as a result, the curled portion is unwound little bit. Accordingly, the springback varies a shape or dimensions of the curled portion, and this may cause a variation in the sealability between the curled portion and the cap (or a seal member).

In order to solve the fluctuation of the sealability between the curled portion and the sealing member, it is conceivable that the threaded cylindrical body made of resin is inserted into the neck portion and fixed by the curled portion. However, the threaded cylindrical body made of resin cannot be easily removed from the metal can body (i.e., the bottle-shaped can etc.), and not so small to be neglected at the stage of recycling. Therefore, a recycling efficiency of the can body is degraded.

The first object of the present invention is to provide a curl configuration of the opening portion of the metal can, which can solve the above-mentioned problems. Specifically, the object of the present invention is to provide a curled portion which is formed such that the trim end of the curled portion is rolled in and confined at the opening portion of the can. With this curled portion according to this invention, the trim end is prevented from gathering rust; the hair-like string resin of film at the trim end is hidden; and the adequate sealability is attained between the curled portion and the cap (i.e., a seal member), without neither being deformed by the pressure from above or drop impact, nor causing variation in its shape and size due to the springback.

The second object of the present invention is to provide a method for forming the curled portion having such a configuration.

To form the outwardly curled portion on the opening portion of the can, conventionally, a flanging is applied to the opening portion of the can, the portion around which is still in a cylindrical shape, by e.g., pressing from above by a disc-shaped head having at its lower end a working face in a circumferential direction, or by contacting a plurality of working rollers held rotatably by a rolling head with the opening portion and thereby pressing from above with rotating the rolling head. Then, the flanged portion is so curled as to inflect downwardly, thereby forming the curled portion which has a generally round cross-section.

On the contrary, the outwardly curled portion of the metal can according to the present invention is formed differently from the conventional curled portion having a generally round cross-section, as will be described hereinafter. As illustrated in FIGS. 5 and 11, first of all, the trim end of the opening portion is folded outwardly over a predetermined length, and then this folded portion is flanged outwardly and further folded downwardly. As illustrated in FIG. 5, such flanging and folding are repeated again. As compared to the conventional forming of the curled portion (i.e., flanging and curling), a great power is required for such flanging and folding to form the curled portion.

Specifically, in the forming process of the curled portion, a metallic material of the processed portion is elongated at the stage of flanging, because the processed portion moves outwardly so that the diameter increases. On the contrary, the metallic material of the processed portion is contracted at the stage of folding, because the processed portion moved outwardly is then displaced inward and downward so that the diameter decreases. Therefore, the processed portion as thus elongated and contracted is simply a single configuration according to the curled portion of the prior art having the generally round cross-section, whereas according to the curled portion of the present invention, the processed portion is a multiple configuration (i.e., a two-fold configuration after the first flanging and folding, and a three-fold configuration after the second flanging and folding). It follows that the greater force is required to elongate and contract the metal material of the processed portion as compared to the case of forming the curled portion according to the prior art; however, applying the great force (i.e., the pressure by a forming tool) at a working time may cause a damage on the resin film covering an inner face of the opening portion contacting with the forming tool.

The second object of the present invention is to solve the above-mentioned problem. Specifically, the present invention is aimed at providing a forming method of the curled portion of the metal can, in which the resin film covering the inner face of the opening portion of the can contacting the forming tool is not damaged, when forming the outwardly curled portion by folding the opening portion outwardly into two folds over the predetermined length from the trim end, and then flanging and folding so as to curl the trim end.

DISCLOSURE OF THE INVENTION

In order to achieve the aforementioned objects, according to the present invention, there is provided a curled portion of a metal can which is formed into an outward curl on an opening portion of the metal can, characterized: in that both surfaces of a metal sheet forming at least the opening portion and its vicinity have a resin film layer; and in that the curled portion is formed such that a trim end of the opening portion is rolled in and confined, a lower end of the curled portion is in contact with an inclined face extending between a wall portion to be threaded and the curled portion, and layers of the metal sheet forming the curled portion are in radially squeezed close hermetic contact with one another via resin films.

With the configuration of the curled portion according to the present invention, the curled portion is so curled as to confine the trim end therein. Therefore, it is possible to hide the trim end which has esthetically undesirable hair like strings of resin film. Moreover, since the metal sheet layers forming the curled portion are folded in such manner that the layers are in close contact with one another hermetically via resin film, the external moisture is prevented from reaching the trim end of the curled portion. Accordingly, it is possible to prevent effectively the trim end from getting corroded.

Since the curled portion is squeezed in the can radius (can thickness) direction and the lower end thereof stays on the inclined face, moreover, the curled portion is rarely deformed by the pressure from above or the drop impact. Furthermore, there is scarcely any possibility of springback. Therefore, the sealing member of the cap can be maintained in stably contact with the curled portion.

Furthermore, since the curled portion is squeezed in the can radius (thickness) direction, the entire curled portion is thin in the can radius (thickness) direction as compared with a traditional curled portion, and its top portion and its vicinity is thin in the can radius direction as compared with the top portion of the traditional curled portion. Therefore, the cap is mounted on the open end of the can and when the sealing member of the cap urged against the open end of the can, it is compressed readily such that the top portion of the curled portion is received in (cut in) the sealing member, thereby adequate sealability is attained between the sealing member of the cap and the curled portion.

Moreover, the portion curled inside of the curled portion is further folded to orient the trim end downward. The curled portion is squeezed in the can radius direction, and in the most part but except upper and lower ends and its vicinity of the curled portion, the metal sheet is overlapped in four layers in a substantially axial direction of the trim end. The curled portion may be tapered toward the top portion in the vicinity of upper portion.

With the configuration of the curled portion according to the present invention, the trim end is positioned in the innermost of the curled portion so that an intrusion of the external moisture to the trim end of the curled portion can be prevented. Consequently, it is possible to prevent the trim end from rusting.

Also, since the curled portion has four layers of the metal sheet arranged in the can radius direction (can thickness direction), it has adequate strength against vertical load from above. Even the metal sheet is overlapped in four layers in the can radius direction, on the other hand, the top portion of the curled portion and vicinity thereof is thin in the can radius direction as compared with the top of the traditional curled portion, and when the metal can is capped, the top portion of the curled portion is readily received in a sealing member of a cap, thereby adequate sealability is attained between the sealing member and the curled portion.

Moreover, at the most part but except upper and lower ends and its vicinity of the curled portion, the metal sheet may be overlapped in three layers in the can radius direction by folding the portion curled inside of the curled portion so as to orient the trim end upward, and then squeezing the curled portion in the can radius direction.

With the configuration of the curled portion according to the present invention, the curled portion is squeezed in the can radius direction so that the entire curled portion is comparatively thin in the can radius direction (or axial direction of the trim end) with the traditional curled portion, thereby adequate sealability is attained between the sealing member and the curled portion.

Moreover, according to the present invention, the metal can may be a bottle-shaped can: wherein at least the neck portion, the shoulder portion and the trunk portion are integrally formed on a bottomed cylindrical one-piece can body shaped from the resin coated metal sheet on both sides of which the resin film is formed; wherein the outwardly curled portion is formed on an upper end opening edge of the neck portion; and wherein a peripheral wall of the neck portion is threaded. The bottle-shaped can of this kind is exemplified by a bottle-shaped can in which the neck portion and the shoulder portion are formed by processing a bottom side of the bottomed cylindrical can body, or a bottle-shaped can in which the neck portion and the shoulder portion are formed by processing the opening portion side of the can body.

With the configuration of the curled portion according to the present invention, since the bottomed cylindrical can body is shaped from the resin coated metal sheet, the resin functions as lubricant, as suggested in WO01/15829 and WO01/23117 in detail. In addition, the resin film is transformed in accordance with the deformation of the metal sheet; therefore, the amount of the lubricant can be saved and the metal surface hardly gets scratched by a forming tool, and furthermore, an additional protective coating or the like is scarcely required after the forming process of the can body. Accordingly, an additional protective painting is not essentially required even after the curled portion and the threaded portion are formed. Here, needless to say, it is preferable to apply the additional protective painting if the processing conditions are particularly severe.

Moreover, according to the present invention, the metal can may be a bottle-shaped can: wherein at least the neck portion, the shoulder portion and the trunk portion are integrally formed on a bottomed cylindrical one-piece can body shaped from a metal sheet carrying coating resin films on its both faces; wherein the outwardly curled portion is formed on the upper end opening edge of the neck portion; and wherein a peripheral wall of the neck portion is threaded. The bottle-shaped can of this kind is exemplified by a bottle-shaped can in which the neck portion and the shoulder portion are formed by processing the bottom side of the can body, or a bottle-shaped can in which the neck portion and the shoulder portion are formed by processing the opening portion side of the can body.

With the configuration of the curled portion according to the present invention, therefore, the neck portion and the shoulder portion can be formed from the can body of a drawn and ironed can shaped by an ordinary and widely implemented drawing and ironing, and painted/printed on its both inner and outer faces. Accordingly, the cost for new equipments can be saved.

Moreover, according to the present invention, the metal can may be a bottle-shaped can: wherein the neck portion and the shoulder portion are formed on an open end of a cylindrical welded can trunk shaped from a resin coated steel sheet carrying coating resin films on its both sides except a portion to be welded; wherein the outwardly curled portion is formed on the upper end open edge of the neck portion; wherein a peripheral wall of the neck portion is threaded; and wherein a separated bottom wall (bottom end) is attached to the other open end.

With the configuration of the curled portion according to the present invention, since the welded can made of a surface-treated steel sheet can be used as a starting material, it is possible to provide the bottle-shaped can the outer face of which has excellent decorative printing characteristics. Also, most of existing welded can manufacturing equipments can be diverted without any modification; therefore, it is possible to control a can manufacturing cost.

Moreover, according to the present invention, there is provided a curled portion of the metal can, in which at least the opening portion of the metal can and vicinity thereof is shaped from the metal sheet wherein thermoplastic resin coating is applied to its both sides, and in which the outwardly curled portion is formed on the opening, characterized: in that the outwardly curled portion is formed such that the trim end of the curled portion is rolled in and confined with squeezing in the can radius direction; in that the metal sheet layers forming the curled portion are folded in such manner that at least three or more layers are in close contact with one another hermetically via resin films, in most part but except both upper and lower ends and its vicinity of the curled portion; and in that at least a contact portion between the first and second metal sheet layers from the inside of the can are bonded mutually by the thermoplastic resin film fused with each other.

With the configuration of the curled portion according to the present invention, therefore, at least the first and the second metal sheet layers from the inside of the can are thermally bonded by the fused thermoplastic resin films. Specifically, the adhesion of the thermoplastic resin film blocks a penetrating route of the external water or the like to the trim end in the curled portion. Therefore, the penetration of moisture to the trim end inside of the curled portion can be certainly prevented, even if the metal sheet is overlapped in three layers in the can radius direction of the curled portion.

In addition, in case the of the metal sheet is overlapped in the can radius direction of the curled portion in four layers, the moisture can be prevented from penetrating to the trim end of the curled portion almost certainly, only by substantially folding the metal sheet layers are in close contact with one another hermetically via resin films. Even if some sort of an external force acts on the curled portion to loose the contacting state of the metal sheet layers, no space for the moisture penetration is created by providing the contact portion between the metal sheet layers with a bonded portion by the fused resin films. Accordingly, the moisture can be prevented more certainly from penetrating the trim end of the curled portion.

According to the present invention, moreover, the metal can may be a bottle-shaped steel can: wherein a diametrically small cylindrical neck portion, an inclined shoulder portion and a diametrically large trunk portion are integrally shaped from a resin coated steel sheet in which both sides are laminated with thermoplastic resin films; wherein an outwardly curled portion is formed on an upper end opening edge of the neck portion; and wherein a peripheral wall of the neck portion below the curled portion is threaded.

According to the present invention, therefore, the trim end of the curled portion can be absolutely prevented from getting rusty, even if the bottle-shaped steel can is shaped from the steel sheet which is tendency to get rusty in comparison with the aluminum sheet.

According to the present invention, moreover, the metal can may be a bottle-shaped steel can: wherein a neck portion and a shoulder portion are formed on an open end of a cylindrical welded can trunk shaped from a resin coated steel sheet carrying resin films on its both surfaces except the portion to be welded, and both surfaces of a welded portion of the can trunk and vicinity thereof are covered with resin films; wherein an outwardly curled portion is formed at an upper end open edge of the neck portion, wherein a peripheral wall of the neck portion is threaded, and wherein a separated bottom wall (bottom end) is attached to the other open end.

According to the present invention, therefore, the trim end of the curled portion can be absolutely prevented from getting rusty, even if the welded can is used for the bottle-shaped steel can.

According to the present invention, moreover, there is provided a forming method of the outwardly curled portion of the metal can, wherein a process for folding an opening portion of the metal can outwardly in two folds over a predetermined length from a trim end of the opening portion is applied to the metal can, in which the trim end and vicinity thereof is still in a cylindrical shape, and in which at least an inner face side is covered with a resin film, and after this, a flanging and a folding are applied to the folded portion, characterized: in that when flanging the folded portion outwardly, the opening portion of the can is flanged sequentially part by part in the circumferential direction by applying a pressure of the spinning die from above while rotating the can and a disc-shaped spinning die having a rotating shaft inclined with respect to an axial direction of the can in the same direction, and keeping a portion of an outer circumferential working face of the spinning die in substantial line contact with the opening portion of the can from inside; and in that when refolding the flanged folded portion downwardly, the opening portion of the can is folded sequentially part by part in the circumferential direction, by applying a sideways pressure by means of an annular internal roller which moves in the direction perpendicular to the axial direction of the can, with bringing the internal roller into substantial line contact with the opening portion of the rotating can from outside.

With the forming method of the curled portion according to the present invention, the opening portion of the can is processed sequentially part by part in the circumferential direction by bringing the forming tool into substantial line contact with a part of the opening portion of the can in the circumferential direction, in the process of the flanging and the folding for shaping the outwardly curled portion. Therefore, it is possible to process the opening portion of the can without raising a pressure of the forming tools so much, even if the processing portion is folded into two (or three) layers. As a result of this, it is possible to prevent the resin film covering the inner face of the opening portion of the can from being damaged by the contact of the forming tool when forming the curled portion.

According to the method of the present invention, moreover, the metal sheet of the curled portion may also be overlapped in four layers being in close contact with one another via the resin films, in the most part but except both upper and lower ends and its vicinity of the curled portion, by folding the opening portion into two folds over a predetermined length from the trim end, by carrying out the flanging and the folding sequentially, and then further flanging and folding the refolded portion, thereby to squeeze the folded portion in its entirety in the can radius direction.

With the forming method of the curled portion according to the present invention, therefore, it is possible to form the curled portion comparatively easily, which has a high resistance against a pressure from above and a preferable sealability between the curled portion and the sealing member of the cap, and which can be prevented from getting corroded at the trim end in the curled portion due to external moisture almost perfectly.

According to the present invention, moreover, the metal can may be a bottle-shaped can, which is shaped from a resin coated metal sheet in which both sides thereof are laminated with thermoplastic resin films; wherein a neck portion, a shoulder portion and a trunk portion are formed integrally; wherein the curled portion is formed on an upper end of the neck portion; and wherein a peripheral wall of the neck portion is threaded.

With the forming method of the curled portion according to the present invention, therefore, the formability is satisfactorily kept with a small amount of lubricant during the process from forming the bottomed cylindrical can body until forming the curled portion and the threaded portion. Also, no additional protective coating is basically required. According to the present invention, moreover, it is possible to form a bottle-shaped can comprising the curled portion and the threaded portion having high corrosion resistance, sealability and resistance against the pressure from above.

With the forming method of the curled portion according to the present invention, moreover, the metal sheet to be used as a material may be an aluminum alloy sheet.

With the forming method of the curled portion according to the present invention, the can body is shaped from the aluminum alloy sheet. Therefore, it is possible to provide the bottle-shaped can having satisfactory formability, excellent in corrosion resistance, and comparatively lighter in weight.

With the forming method of the curled portion according to the present invention, moreover, the metal sheet to be used as a material may be a steel sheet.

With the forming method of the curled portion according to the present invention, therefore, the bottle-shaped can is shaped from the steel sheet which is comparatively lower in cost and abundant as a resource so that the cost of the can body can be kept low.

According to the present invention, moreover, there is provided a forming method of the outwardly curled portion of a metal can: which is shaped from a resin coated metal sheet carrying thermoplastic resin films on its both surfaces; and in which a trim end of an opening portion and vicinity thereof is still in a cylindrical shape, wherein a folding for folding the opening portion over a predetermined length from the trim end outwardly into two folds is applied to the metal can, and after this, a flanging and a folding are applied to curl the trim end to form the outwardly curled portion, characterized: in that when flanging the folded portion outwardly, the opening portion of the can is flanged sequentially part by part in the circumferential direction by applying a pressure of the spinning die from above while rotating the can and a disc-shaped spinning die having a rotating shaft inclined with respect an axial direction of the can in the same direction, and keeping a portion of an outer circumferential working face of the spinning die in substantial line contact with the opening portion of the can from inside; and in that when refolding the flanged folded portion downwardly, the opening portion of the can is folded sequentially portion by portion in the circumferential direction, by applying a sideways pressure by means of an annular internal roller which moves in the direction perpendicular to the axial direction of the can, with bringing the annular internal roller into substantial line contact with the opening portion of the rotating can from outside; and in that the metal sheet layers of the curled portion are thermally bonded with each other, by folding the metal sheet layers, in which both sides thereof are covered with the thermoplastic resin films and contacting closely with one another via thermoplastic resin films in most part of the curled portion except both upper and lower end portions, and then heating at least the curled portion and vicinity thereof to soften or melt the thermoplastic resin films, so as to fuse the thermoplastic resin films of the folding layers together.

With the forming method of the curled portion according to the present invention, the metal sheet layers of the curled portion can be thermally bonded with one another via the resin films of the contact portion by just heating the formed curled portion locally by an appropriate heating means. Therefore, according to the forming method of the present invention, the workability can be improved by adopting an appropriate means which is simple as compared to the methods of bonding the contacting portion between a lower portion of the curled portion and an inclined face, e.g., by applying a thermosetting resin in the circumferential direction, by attaching a molten thermoplastic resin, or by irradiating the contacting portion with a laser to fuse resin films of the contacting portions together.

With the forming method of the curled portion according to the present invention, moreover, the curled portion is squeezed in its entirety in the can radius direction by folding the opening portion into two folds over the predetermined length from the trim end, by applying the flanging and the folding sequentially, and by applying those once again. Therefore, according to the present invention, the process for heating at least the curled portion and vicinity thereof may be carried out after folding the metal sheet to overlap therewith in four layers being in close contact with one another via the resin films in the can radius direction in the most part but except both upper and lower ends and of the refolded portion.

With the forming method of the curled portion according to the present invention, the process for heating at least the curled portion and vicinity thereof is carried out after folding the metal sheet to overlap therewith in four layers being in contact with one another via the resin films in the can radius direction in the most part but except both upper and lower ends and its vicinity of the curled portion. Therefore, the trim end in the curled portion is protected perfectly so that the penetration of the external water can be prevented perfectly. As a result of this, the trim end can be absolutely prevented from getting rusty even if the material is a steel sheet which is tendency to get rusted.

DESCRIPTION OF THE PREFERRED EMBODIMENTS

Figure 1:
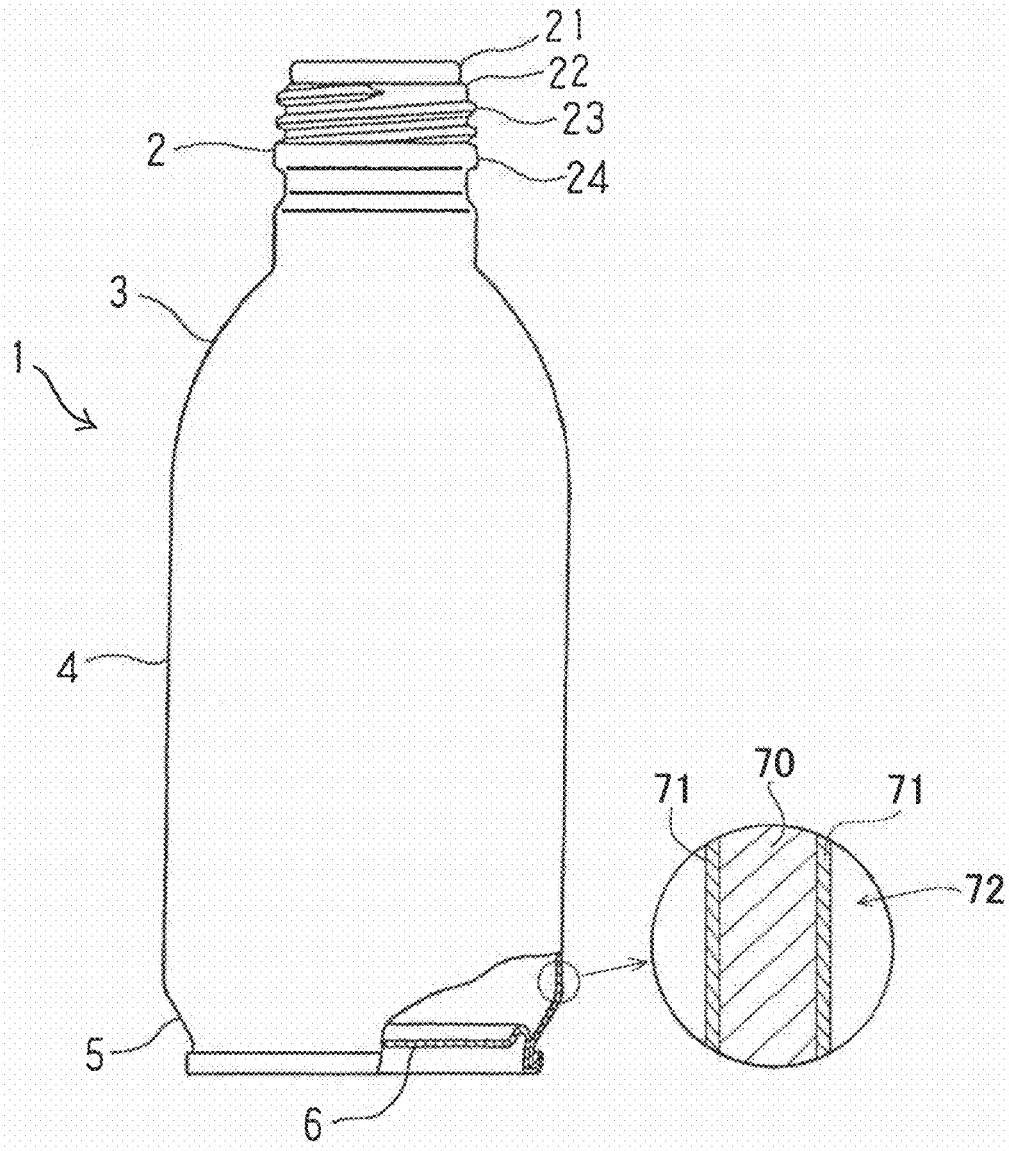
FIG. 1 is a side view showing an overall appearance of a bottle-shaped can except a cap, as one example of a metal can to which a curled portion forming method of the invention is applied.
Figure 2:
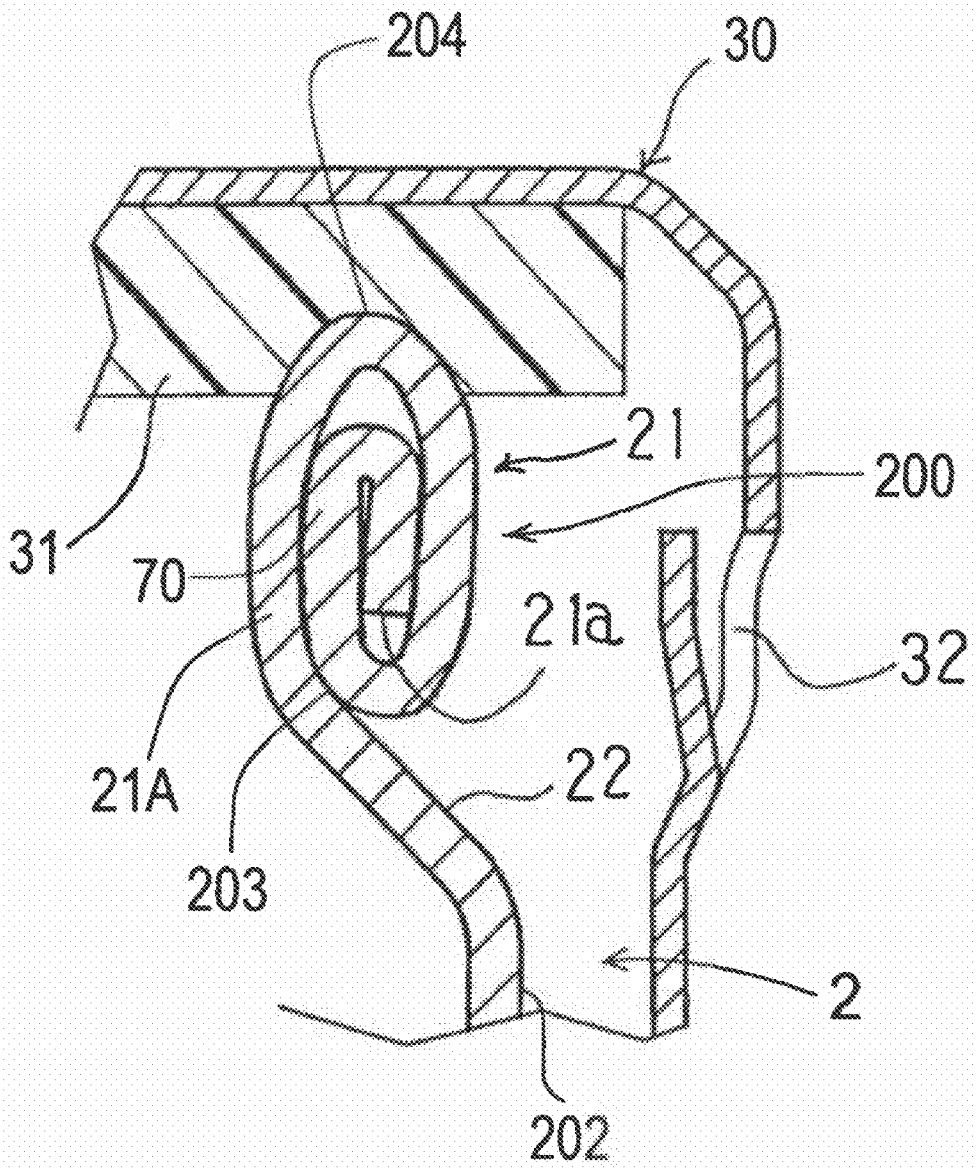
FIG. 2 is an enlarged partial sectional view showing a configuration of the curled portion in which the cap is capped on the can.
Figure 3:
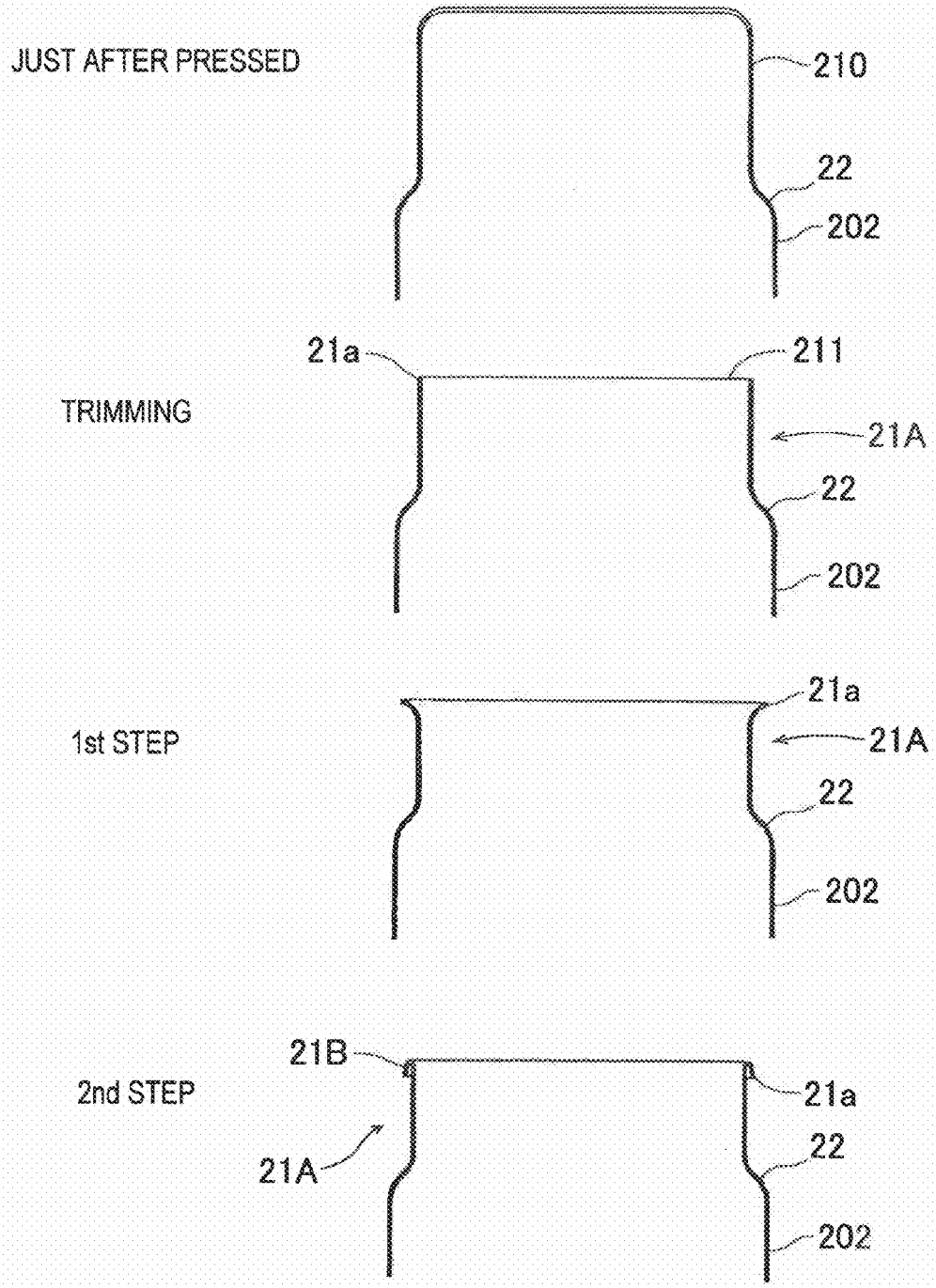
FIG. 3 is an explanatory drawing showing sections of the can at individual steps in an anterior half of steps for forming the curled portion on an opening portion (i.e., an upper end portion of a neck portion) of the bottle-shaped can.
Figure 4:
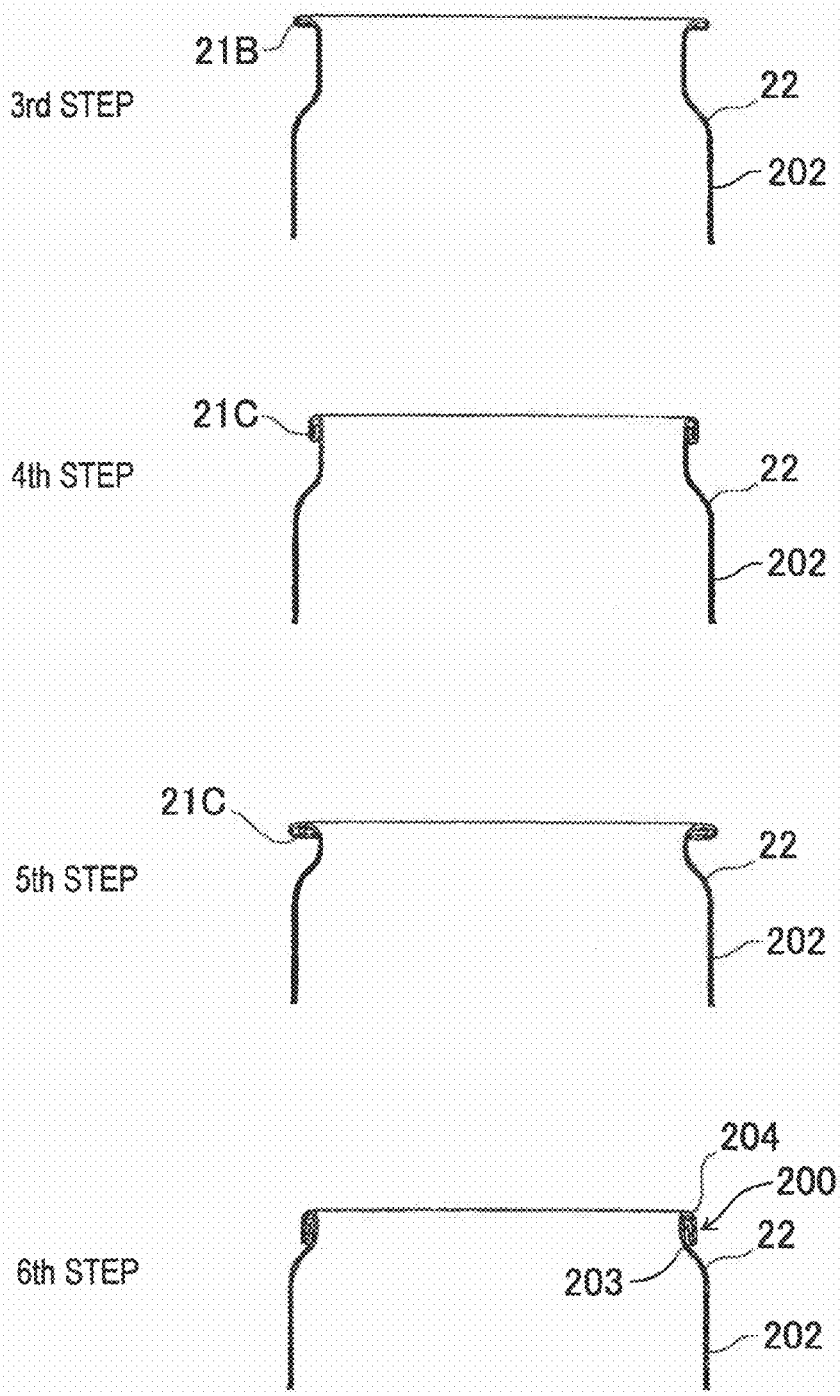
FIG. 4 is an explanatory drawing showing sections of the can at individual steps in a posterior half of steps for forming the curled portion on the opening portion (i.e., the upper end portion of the neck portion) of the bottle-shaped can.
Figure 5:
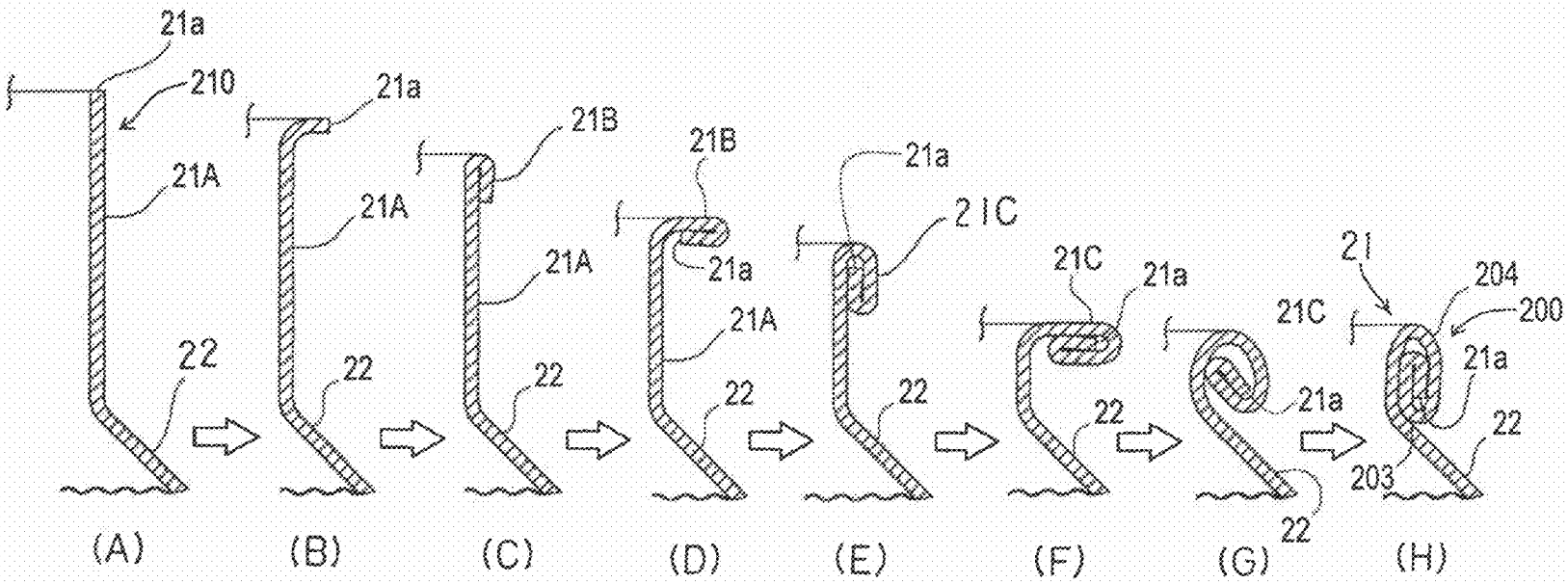
FIG. 5 is an explanatory drawing showing enlarged sections of a processing state in the vicinity of the opening portion of the bottle-shaped can at individual steps shown in FIGS. 3 and 4.
Figure 6:
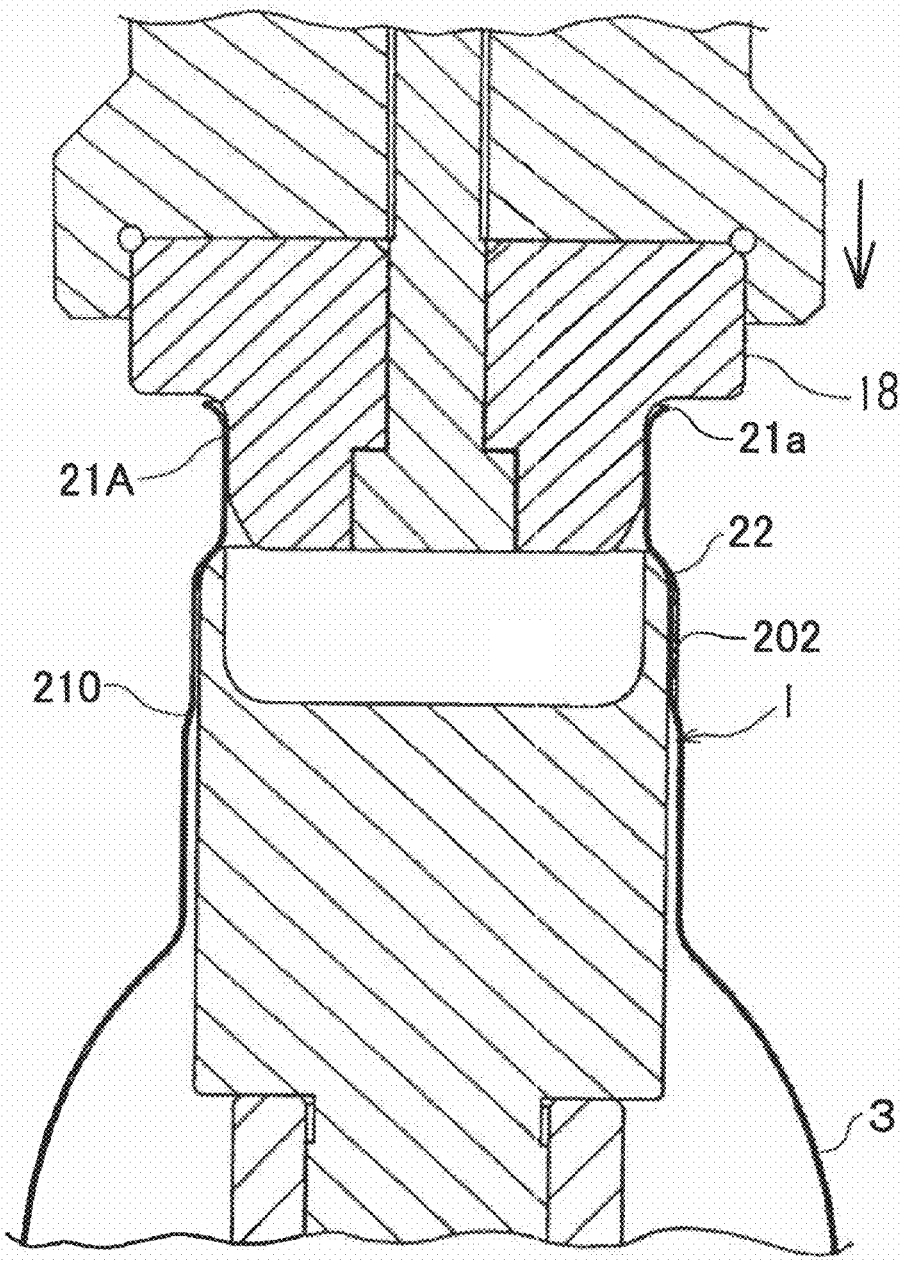
FIG. 6 is a sectional view showing a processing apparatus of at a first step shown in FIG. 3.
Figure 7:
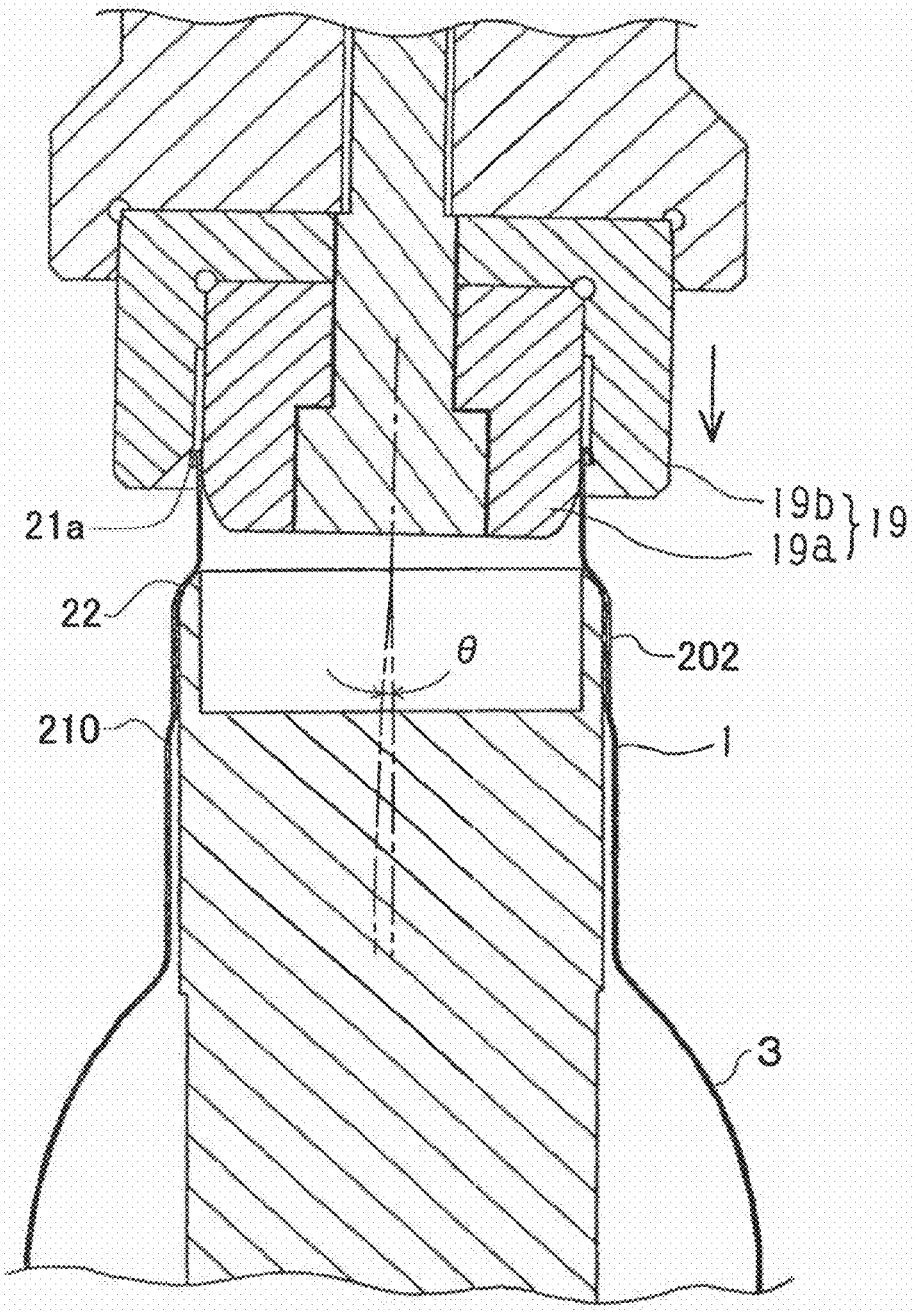
FIG. 7 is a sectional view showing a processing apparatus of at a second step shown in FIG. 3.
Figure 8:
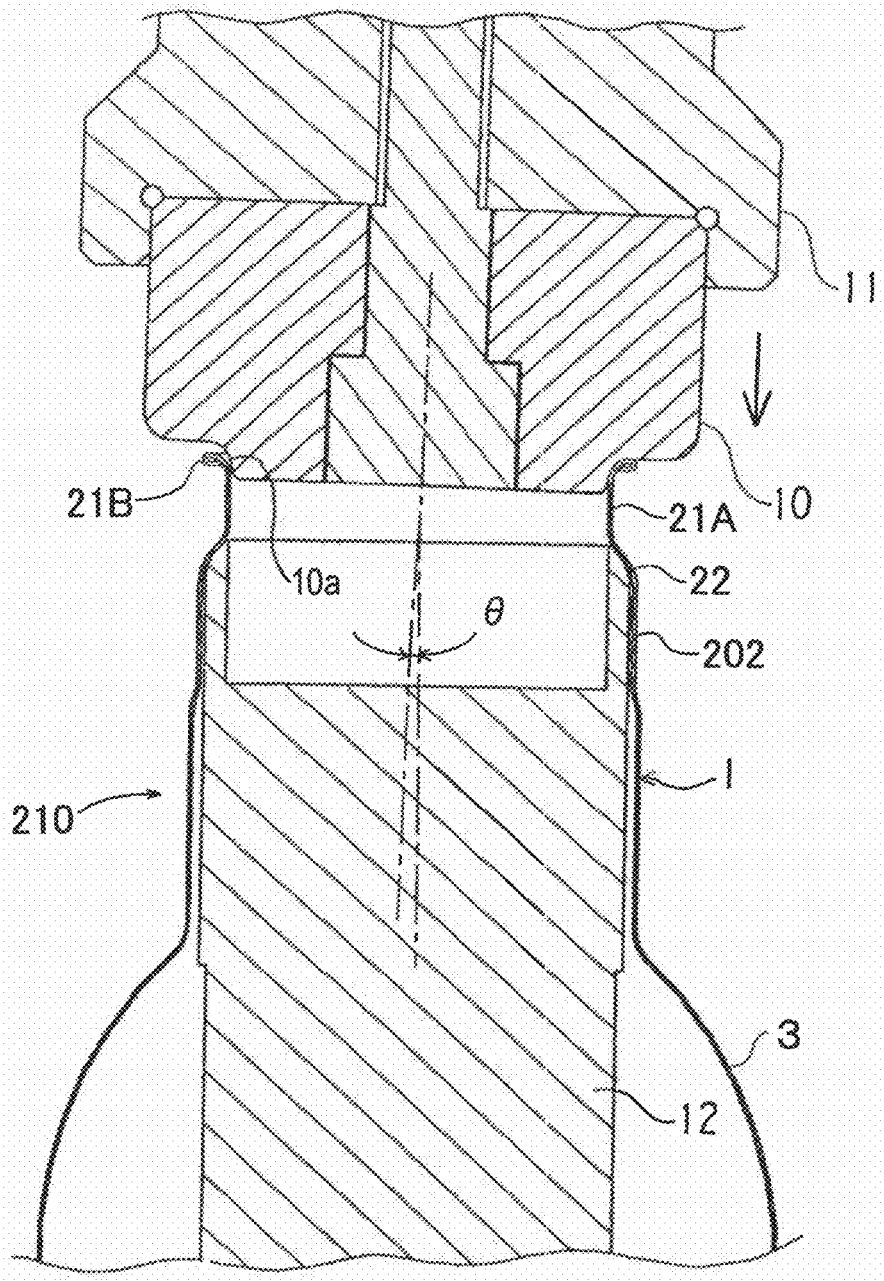
FIG. 8 is a sectional view showing a processing apparatus of at a third step shown in FIG. 4.
Figure 9:
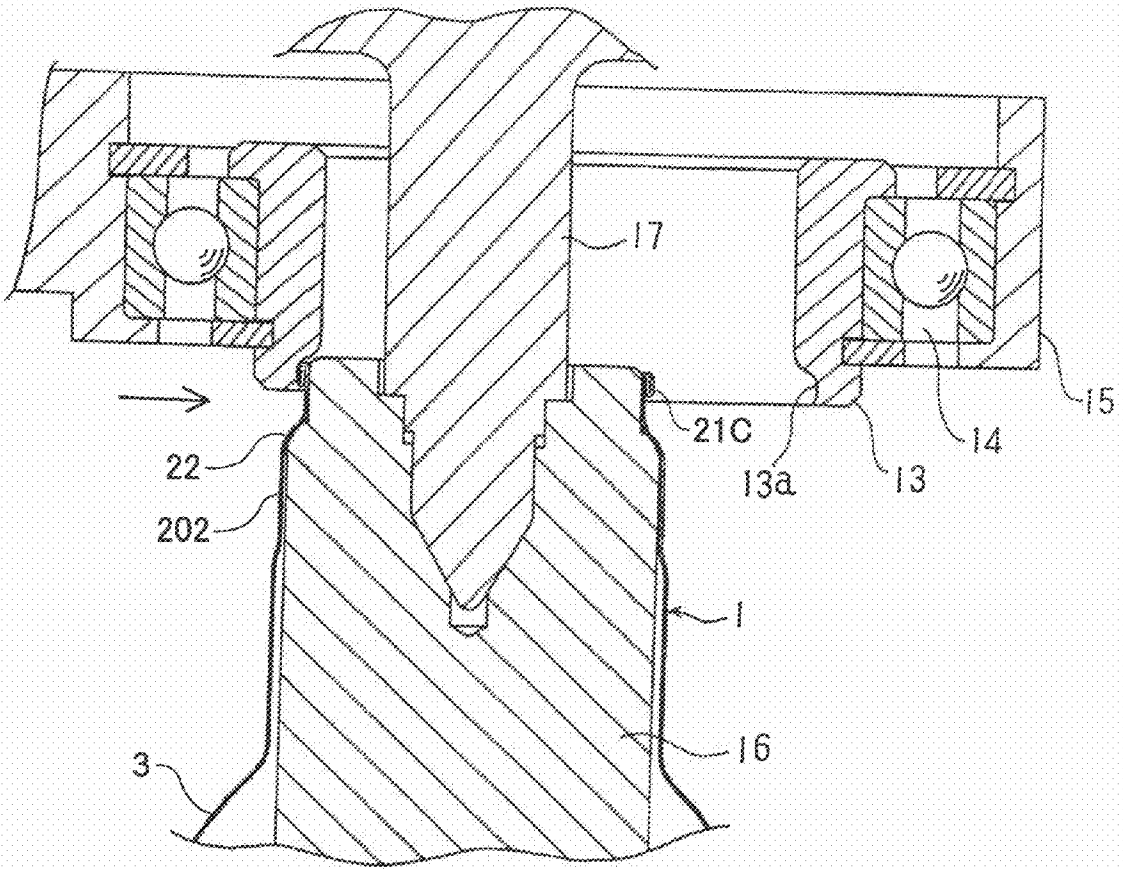
FIG. 9 is a sectional view showing a processing apparatus of at a fourth step shown in FIG. 4.

Here will be described specific embodiments of the forming method of the opening curled portion of the metal can according to the present invention with reference to the accompanying drawings. Here, individual drawings illustrate the embodiments of the forming method according to the invention. FIG. 1 illustrates an overall appearance of a bottle-shaped can as one example of a metal can formed by the method of the invention; FIG. 2 illustrates a configuration of the opening curled portion wherein the cap is capped on the can in a magnified form; FIGS. 3 and 4 illustrate individual steps of shaping the opening end portion and vicinity thereof into the curled portion after trimming a top portion of the can; FIG. 5 illustrates a processing state in the vicinity of the opening end portion at individual steps shown in FIGS. 3 and 4; FIG. 6 illustrates a processing apparatus at a first step shown in FIG. 3; FIG. 7 illustrates a processing apparatus at a second step shown in FIG. 3; FIG. 8 illustrates the processing apparatus at a third step shown in FIG. 4; and FIG. 9 illustrates the processing apparatus at a fourth step shown in FIG. 4.

A metal can 1 according to the first embodiment of the invention is a bottle-shaped steel can (capacity thereof is 190 g). As shown in FIG. a diametrically large trunk portion 4, a dome-shaped shoulder portion 3 having an arcuate cross-section, and a diametrically small cylindrical portion 2 are formed integrally from bottom to top. Moreover, a separately prepared bottom lid (bottom end) 6 made of metal is attached to a lower end of the necked in portion 5 (i.e., a flange portion formed on the lower end opening edge) formed by reducing a diameter of the lower end side of the trunk portion 4 by a double-seaming method.

The annular outwardly curled portion 21 is formed on an upper end opening edge of the neck portion 2 of the bottle-shaped can. A thread 23 is formed on a cylindrical peripheral wall positioned below an inclined face 22 positioned below the curled portion 21. Namely, the inclined face 22 is extending between a wall portion to be threaded and the curled portion. And an annular bead portion 24 is formed below the thread 23. Subsequent to filling the can with a beverage, a separated metal cap is capped onto the neck portion 2 in a resealable manner by a known capping device (a roll-on type capper not shown).

The neck portion 2, the shoulder portion 3 and the trunk portion 4 (also the necked in portion 5 and the flange portion formed on the lower end side of the trunk portion 4) are shaped integrally from a resin coated steel sheet 72 which is prepared by coating both sides of a steel sheet 70 with resin films 71. The resin coated steel sheet 72 can be exemplified by a resin coated steel sheet, which is prepared by laminating thermoplastic resin films (specifically, a polyester resin containing PBT and PET (polybutylene terephthalate and polyethylene terephthalate) in a mixture proportion of 6 to 4) in advance, e.g., a polyester resin, a polypropylene resin or the like, onto a steel sheet (specifically, an electrolytic chromate treated steel sheet) having a thickness of 0.230 mm, 25 μm in thick on a face to be used as an inner face of the can, and 12 μm thick on a face to be used as an outer face of the can.

The steel sheet 70 used as a base material of the resin coated steel sheet 72 can be exemplified by a metal plated steel sheet as subjected to a known conversion treatment such as a chromate treatment, a phosphate treatment, an organic/inorganic compound type conversion treatment or the like, after various kinds of metal plating; for example, such a surface treated steel sheet as a nickel-plated steel sheet, a tin-plated steel sheet, an extremely thin tin plated steel sheet, a galvanized steel sheet, a chrome-plated steel sheet, an electrolytic chromate treated steel sheet (TFS-CT) such that a conversion coating film is applied directory to the steel sheet, a phosphate treated steel sheet, an organic/inorganic compound type conversion treated steel sheet and so on. Although a metal sheet other than the steel sheet can be employed as a material of the bottle-shaped can, an aluminum sheet or an aluminum alloy sheet is especially suitable in view of formability.

There are two methods for laminating the thermoplastic resin film on both sides of a steel sheet 70 as a resin film 71. One is a method in which the thermoplastic resin film is thermally laminated (by heat adhering) on both sides of a steel sheet 70 directly, and the other is a method in which the thermoplastic resin film is thermally adhered through an adhesive layer. In case of laminating the thermoplastic resin films on both sides of a steel sheet 70 as a protective coating, the resin films may be formed not only by laminating with the thermoplastic resin films, but also by coating with a thermosetting coating material. In this case, the steel sheet 70 may be coated in advance and then a bottomed cylindrical in-process product (i.e., a deep cup in which the neck portion and the shoulder portion has not been formed thereon yet) is shaped from the resin coated steel sheet 72, or alternatively, the bottomed cylindrical in-process product is shaped from the steel sheet 70 first, and then both inner and outer faces of the bottomed cylindrical in-process product are coated.

The methods disclosed in the specifications of the aforementioned U.S. Pat. No. 6,463,776 and U.S. Pat. No. 6,499,329 can be applied to the method of manufacturing the bottle-shaped can from the resin coated steel sheet. The outline, which is not shown in the drawings, will be described hereinafter. First of all, an appropriate lubricant is applied in advance on the resin film (i.e., a thermoplastic resin layer) covering both sides of the resin coated steel sheet. Then, at a cup forming step, an disc-shaped blank is punched out (stamped out) of the resin coated steel sheet and formed into a shallow cup-shape by drawing. After this, at a can trunk forming step, a bottomed cylindrical in-process product thinned at its trunk portion (i.e., a deep cup in which the neck portion and the shoulder portion has not yet been formed thereon) is manufactured by re-drawing (including a stretching) and ironing in combination.

Next, at a top doming step, a small cylindrical neck portion (not yet opened) and a dome shaped shoulder portion are formed by drawing more than once and reforming the bottom side of the bottomed cylindrical in-process product, so as to form a basic form of the bottle-shaped can. Then, a mouth-drawing is applied twice to an end portion of unopened neck portion, the lubricant is volatilized, a height of the in-process product is made equal by trimming an opening end side of the trunk portion, and a decorative printing is applied to an outer face of the trunk portion. After this, the unopened neck portion is opened by trimming its leading end at a threading/curling step, an annular outwardly curled portion is formed on the upper end opening edge of the neck portion, a thread is formed on a cylindrical peripheral wall below the curled portion, and an annular bead portion is formed below the thread.

Then, at a necking/flanging step, a necked in portion and a flange portion are formed on a lower end side of the trunk portion by necking/flanging the opening end (i.e., a lower opening end) and its vicinity of the trunk portion of the opposite side of the neck portion. Subsequently, at a bottom lid seaming step, a separated bottom lid (bottom end) is integrally attached to the flange portion formed on the lower end opening edge of the necked in portion by a double-seaming method. As a result, the bottle-shaped can (a can in which the cap has not been capped thereon yet) as shown in FIG. 1 is manufactured.

Here, subsequent to filling the bottle-shaped can manufactured as thus has been described with the beverage, a separated metal cap (i.e., a pilfer proof cap) is put on the neck portion. Then, in order to form a thread on a skirt portion of the cap, sideways pressure is applied to the skirt portion by thread forming rollers to press the skirt portion against the thread portion of the neck portion, while applying a pressure to a top portion of the cap from above by a top presser of a known capper (i.e., a capping device). At the same time, the lower end of the skirt portion is drawn inwardly from the side by a drawing roller so as to fit the lower end of the skirt portion into an annular recess portion of the neck portion, thereby fixing the cap with the neck portion. When the cap is thus capped, a strong pressure (883 to 1274N) acts on the curled portion of the upper end of the neck portion from above.

On the other hand, the outwardly curled portion formed at the threading/curling step is, as shown in FIG. 2, so curled as to confine a trim end portion 21*a* of the opening portion inside of the curled portion 21 by a forming method of this embodiment to be described hereinafter. In the most part but except both upper and lower ends of the curled portion 21, there is a folded portion 200 which is folded into four layers being squeezed in the can radius (the can thickness) direction so as to fold the metal sheet layers being in close contact with one another hermetically via the resin films. Moreover, the lower end of the curled portion 21 contacts with a subjacent inclined face 22 formed between a portion 21A to be curled of the neck portion 2 and a portion 202 to be threaded by applying the mouth-drawing twice, thereby to form a contact portion 203. The upper portion of the curled portion 21 and vicinity thereof is tapered toward the top portion 204 of the curled portion 21.

According to the curled portion 21 thus formed, the trim end portion 21*a* is so curled in and confined inside of the curled portion 21, therefore, even if the resin film 71 is peeled and fluffed hair like strings in the manufacturing process (i.e., when the leading end of the unopened neck portion 2 is trimmed to be opened), and the trim end portion 21*a* of the opening portion gets visually undesirable, such visually undesirable portion can be completely hidden. Moreover, in the curled portion 21, the metal sheet layers are folded in such manner that the layers are in close contact with one another hermetically via resin films 71. Therefore, it is possible to certainly prevent external moisture from reaching the trim end portion 21*a* thereby to prevent the curled portion 21 effectively from getting corroded, even if the external moisture enters from vent slits 32 of the cap 30. As a result, it is possible to certainly prevent the trim end portion 21*a* from getting rusty even if the metal can 1 is a steel can.

Moreover, since the curled portion 21 is squeezed in the can radius direction while bringing the lower end in contact with the inclined face 22 positioned between the curled portion 21 and the thread 23, the curled portion 21 is rarely deformed even if it is pressurized from above by the capper when the cap is capped thereon, or even if it experiences a drop impact by accident after being manufactured into a canned product. Additionally, the curled portion 21 does not cause the springback so that its shape and dimensions will not be changed. Accordingly, adequate sealability can be maintained stably between the sealing member 31 of the cap 30 and the curled portion 21. Especially, the metal sheet layers are overlapped in four layers in the can radius direction except in the vicinity of both upper and lower ends of the curled portion 21. It is quite effective to prevent penetration of the water into the curled portion 21 and to enhance a resistance against deformation.

Moreover, since the curled portion 21 is tapered toward the top portion 204, when the cap 30 is capped on the neck portion 2, a seal member 31 of the cap 30 is pressurized from above by the capper to contact with the top portion 204 of the curled portion 21, and the top portion 204 of the curled portion 21 is received in (cut in) a surface of the sealing member 31. As a result, adequate sealability is attained between the sealing member 31 of the cap 30 and the curled portion 21. In addition, in order to enhance the sealability, a thickness (a dimension of the can radius direction) of a leading end of the top portion of the curled portion 21 is preferably 1.5 mm or smaller, 1.2 mm or smaller is more preferable, and 1.0 mm or smaller is especially preferable.

Here, according to the method of this embodiment, in case of forming the aforementioned curled portion 21, first of all, a leading end (top end) of an unopened (just after pressed) neck portion 210 formed at the top doming step in advance is so cut (or trimmed) as to open the neck portion 210 at the threading/curling step, as shown in FIG. 3. Then, at a first step of the curling step prior to the threading step, a cylindrical opening portion 211 is flanged outwardly over the predetermined length from the trim end portion 21*a*, and at a second step, the flanged portion is folded downwardly so that the cylindrical opening portion 211 is folded outwardly into two folds over the length from the trim end portion 21*a*.

As shown in FIG. 4, moreover, a two-layered folded portion 21B thus formed on the opening end portion is flanged outwardly at a third step, and then, a three-layered folded portion 21C is formed at a fourth step by refolding the flanged folded portion downwardly so as to roll in the trim end portion 21*a* inside of the curled portion 21. After this, at a fifth step, the three-layered folded portion 21C is flanged outwardly, and at a sixth step, the flanged folded portion is refolded downwardly again to form a folded portion 200. Thus, the curl forming is ended.

A processing state in the vicinity of the opening end portion at individual steps of the curling step will be described hereafter more in detail. As shown in FIG. 5, in the state of (A), the leading end of the neck portion 210 is trimmed to be opened and an area above the inclined face 22 corresponds to the portion 21A to be curled. At the first step, a flange is formed as shown in (B). At the second step, the flanged portion is folded into two folds as shown in (C), so that a two-layered folded portion 21B is formed at the opening end portion. Then, at the third step, the two-layered folded portion 21B is flanged as shown in (D). At the fourth step, the two-layered folded portion 21B is folded as shown in (E), thereby to form a small curled portion 21C (i.e., a three-layered curled portion) on the opening end portion. Moreover, at the fifth step, the three-layered curled portion 21C is flanged as shown in (F). Then, through the state as shown in (G), the folded portion 200 squeezed in its entirety in the can radius (the can thickness) direction as shown in (H) is formed at the sixth step. As a result, the curled portion 21 is formed into a final shape. In the curled portion 21 thus formed, the lower end of the curled portion 21 is contacted with the inclined face 22 at the contact portion 203. Also, in the most part but except both upper and lower ends of curled portion 21, the metal sheet is overlapped in four layers in the can radius direction and the metal sheet layers are in close contact with one another hermetically via the resin films. In addition, the curled portion 21 is tapered in the vicinity of the top portion toward the top portion 204.

According to the aforementioned curled portion forming method of this embodiment, as shown in FIG. 8, a disc-shaped spinning die 10 (i.e., a rotational flanging head) having a rotating shaft inclined with respect to an axial direction of the can 1 is used for flanging the two-layered folded portion 21B outwardly at the third step. The opening portion of the can 1 is flanged sequentially part by part in the circumferential direction by applying a pressure from above by of the spinning die 10, while rotating the can 1 and the spinning die 10 in the same direction, and keeping a portion of an outer circumferential working face 10*a* of the spinning die 10 in substantial line contact with the opening portion of the can from inside.

Specifically, the can 1 and the spinning die 10 are rotated in the same direction by holding any one of a shaft member 11 for holding the spinning die 10 fixedly and a mandrel 12 for holding the can 1 detachably in a rotatable condition and driving the other one to rotate, or by driving both of them. In this case, the rotating shaft of the spinning die 10 is inclined with respect to an axial of the can 1 at a slight angle θ. As a result of this, the outer circumferential working face 10*a*, which is formed on the lower end outer edge of the disc-shaped spinning die 10 and extended in the circumferential direction, is contacted obliquely with the upper end of the open portion of the can 1 from inside. Specifically, the outer circumferential working face 10*a* of the disc-shaped spinning die 10 is internally contacted with the opening portion of the can 1 in the state of partial and substantial line contact (i.e., extremely narrow arcuate surface contact). In this state, the two-layered folded portion 21B formed at the opening portion of the can 1 is flanged sequentially part by part in the circumferential direction by applying the pressure from above by the spinning die 10.

In connection with the aforementioned flanging carried out by the spinning die 10, the known method (disclosed, for example, in the art and suggested by e.g., Japanese Published Examined Application No. 60-28571, Japanese Patent Laid-Open No. 10-216893 and Japanese Utility Model Laid-Open No. 5-49123) is such that, for example, a forming tool having a rotation axis inclined with respect to an axis of the material (i.e., the pipe) is used for flanging of an end portion of a cylindrical pipe. According to this method, the end portion of the material (i.e., the pipe) is processed (flanged) sequentially part by part in the circumferential direction by applying the pressure of the forming tool from above while rotating the forming tool and keeping a portion in the circumferential direction of the working face of the forming tool in substantial line contact with a portion of the end portion of the material (i.e., a pipe) in the circumferential direction. However, even though the flanging by the spinning die 10 is basically diverted from such technique, this technique has not been applied to the process of forming the outwardly curled portion on the opening portion of the can so far.

The flanging has been carried out conventionally in the prior art when forming the outwardly curled portion at the opening portion of the can. According to the prior art, for example, an entire opening portion of the can is flanged simultaneously by pressing an entire circumference of the opening portion of the fixed can from above using a disc-shaped flanging head which does not rotate. Alternatively, the opening portion of the can is flanged sequentially part by part by internally contacting a plurality of flanging rollers held rotatably by a roll head with the opening portion of the fixed can, and by pressing the opening portion from above.

On the other hand, according to the method of this embodiment, an annular internal roller 13 (i.e., a folding roller), which moves in the direction perpendicular to the axial direction of the can 1, is used at the fourth step, when refolding the flanged folded portion 21B downwardly, as shown in FIG. 9. Namely, the opening portion of the rotating can 1 is folded sequentially portion by portion in the circumferential direction, by internally contacting a portion of an inner circumferential working face 13*a* of the internal roller 13 in the circumferential direction with the opening portion of the can 1 from outside, in the state of substantial line contact, and by applying the pressure from the side by the internal roller 13 which is held rotatably.

Specifically, the annular internal roller 13 is held rotatably by a frame member 15 through a bearing 14. On the other hand, a rotary drive shaft 17 penetrating a center space of the internal roller 13 is connected with a mandrel 16 for holding the can 1 detachably. The can 1 is rotated through the mandrel 16 by driving the rotary drive shaft 17, and the internal roller 13 is moved horizontally (i.e., in the direction perpendicular to the axial direction of the can 1) by moving the frame member 15 horizontally. As a result of this, the working face 13*a* formed on the lower end inner circumference of the internal roller 13 and extending in the circumferential direction is contacted with the opening outer end portion of the can 1 from outside, and the opening portion of the can 1 is internally and partially contacted with the inner circumferential working face 13*a* of the internal roller 13 in the state of substantial line contact. Then, the flanged two-layered folded portion is folded downwardly and sequentially part by part in the circumferential direction, by applying the pressure of the internal roller 13 from the side.

According to the method of this embodiment, moreover, subsequent to folding the opening portion of the can 1 over the predetermined length from the trim end portion into two folds, at the third and the fourth steps, the flanging and the folding are applied to the two-layered folded portion 21B sequentially as has been described above. After this, at the fifth and the sixth steps, the flanging and the folding are applied again to a small curled portion (i.e., a three-layered folded portion) formed as a result of such process. Although explanations of the flanging at the fifth step and the folding at the sixth step are omitted, those processes are carried out by the same methods as carrying out the aforementioned flanging by the spinning die 10 at the third step and the folding by the internal roller 13 at the fourth step.

Furthermore, at the first and second steps, the method of folding the cylindrical opening portion over the predetermined length from the trim end portion 21*a* outwardly into two folds should not be limited to a specific method but can be carried out by any appropriate method. According to this embodiment, as shown in FIG. 6, the entire opening portion of the can 1 is first flanged simultaneously in the circumferential direction at the first step by pressing the opening portion of the fixed can 1 from above by the disc-shaped flanging head 18 which does not rotate. This is the same method as being conventionally carried out for the flanging in the curl forming. Then, at the second step as shown in FIG. 7, the opening portion of the can 1 is folded sequentially part by part in the circumferential direction using a folding head 19 comprising an inner member 19*a* and an outer member 19*b* by applying the pressure from above by the head 19, while rotating the can 1 and the head 19 in the same direction, similarly to the spinning die 10 of the third step, and keeping a portion in the circumferential direction of a working face (i.e., a clearance between the inner member 19*a* and the outer member 19*b*) of the head 19 in substantial line contact so as to nip the upper end of the opening portion of the can 1.

According to the aforementioned embodiment of the forming method of the opening curled portion of the metal can, the outwardly curled portion 21 is formed by folding the opening portion of the can 1 over the predetermined length from the trim end portion 21*a*, and then curling the trim end portion 21*a* inside. Moreover, the outwardly curled portion 21 formed on the opening portion of the can 1 is squeezed in its entirety in the can radius direction. Accordingly, the metal sheet layers are folded in such manner that the layers are in close contact with one another hermetically via the resin films. Therefore, as has been described already, the resistance against deformation is enhanced, and the penetration of the moisture into the curled portion 21 can be prevented. As a result, the trim end portion 21*a* can be prevented effectively from getting rusty.

Moreover, in the flanging and folding of forming the curled portion 21, the opening portion is processed sequentially part by part in the circumferential direction by keeping the forming tools (i.e., the spinning die 10 and the internal roller 13) partially in substantial line contact with the opening portion of the can 1; therefore, a strong force (i.e., the pressing force) is not required to be applied by the forming tools, even when processing two-layered (or three-layered) folded portion (21B, 21C). In other words, the opening portion can be processed little by little. As a result, the resin film covering the inner face side of the opening portion of the can 1 will not be damaged due to the contact with the forming tools.

In addition, in the aforementioned first embodiment, the threaded portion is formed on the neck portion below the curled portion, subsequent to forming the curled portion on the neck portion.

According to the conventional sequence of forming the curled portion and the threaded portion on the neck portion, the threaded portion is formed after forming the curled portion, or the curled portion is formed after forming the threaded portion. For example, in Japanese Patent Laid-Open No. 2000-191006, there is disclosed an example of forming the curled portion after forming the threaded portion on the neck portion. Also, in the embodiment and the drawings of Japanese Patent Laid-Open No. 10-509095 (corresponding U.S. Pat. No. 5,718,352), there is disclosed an example of forming the threaded portion after forming the curled portion. Additionally, there is described that the curled portion may also be formed after forming the threaded portion.

Since it is easy to be constructed, the drawing illustrating a state where the threaded portion is not formed on the neck portion is used to explain the above-mentioned embodiment. However, according to the present invention, it is needless to say that it is also possible to form the curled portion after forming the threaded portion.

The curled portion 21 functions also to seal a clearance between the sealing member 31 of the cap 30 and the curled portion 21 itself. In case of allowing the inner or outer face of the curled portion 21 to function as a sealing face in the method of the invention, therefore, it is better to form the curled portion 21 after forming the threaded portion.

Specifically, since the mandrel 16 is inserted into inside of the portion 21A to be curled when finally folding of the curled portion, as shown in FIG. 9, a shape of the inner face side of the portion 21A to be curled corresponds to a shape of the outer face of the inserted mandrel 16. As a result, a roundness of the inner face side of the curled portion 21 is improved. Moreover, if the roundness of the inner face side of the curled portion is improved, the roundness of the outer face side is improved naturally. Consequently, the sealability is further enhanced in case of tightly contacting the inner face of the curled portion 21 with the sealing member 31 of the cap 30, or in case of tightly contacting the sealing member 31 of the cap 30 with the outer face of the curled portion 21.

Furthermore, in view of improving the sealability, it is preferable to insert the threading step for forming the threaded portion on the neck portion between the steps (G) and (H) shown in FIG. 5, and then carry out the step (H).

Figure 10:
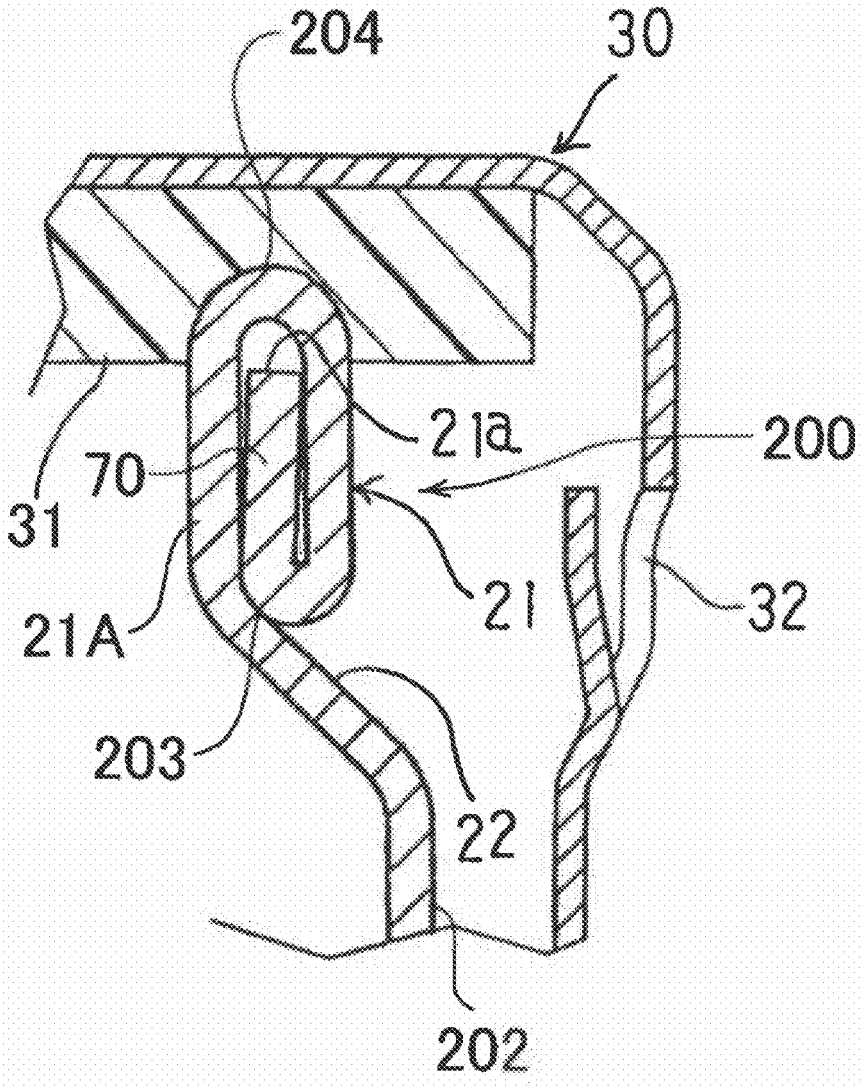
FIG. 10 is an enlarged partial sectional view showing a configuration of the curled portion folded into three layers, in which the cap is capped thereon.

Next, here will be described a second embodiment of the present invention. In the aforementioned first embodiment, there is formed the curled portion in which the metal sheet is overlapped in four layers and squeezed by the pressure in the can thickness (side or can radius) direction. On the other hand, as illustrated in FIG. 10, the second embodiment is one example of forming a curled portion 21 in which the metal sheet is overlapped in three layers.

Specifically, according to the second embodiment of the present invention, an outwardly curled portion (i.e., the opening curled portion) is formed annularly on the upper end opening edge of the cylindrical neck portion, of which both inner and outer faces are covered with the thermoplastic resin films. As shown in FIG. 10, the outwardly curled portion has such a configuration that the trim end portion 21*a* of the opening portion is rolled in and confined inside of a folded portion 200, and squeezed in the can radius (the can thickness) direction. The portion rolled in the folded portion 200 is extended upward in the curled portion 21 so as to orient the trim end portion 21*a* upward. Accordingly, the metal sheet layers are in close contact with one another hermetically via the thermoplastic resin films in the most part but except in the vicinity of both upper and lower ends of the curled portion 21, and the metal sheet is overlapped in three layers in the can radius direction. Moreover, an inclined face 22 is formed between the portion 21A to be curled of the neck portion and the portion 202 to be threaded by applying a mouth-drawing twice, and the curled portion 21 is contacted with the inclined face 22 to form a contact portion 203.

Here will be described one example of a step of forming the folded portion 200 (i.e., the curled portion 21) in which the metal sheet is overlapped in three layers. A bottomed cylindrical in-process product is shaped by drawing/ironing a resin coated metal sheet, in which both sides of an aluminum alloy sheet (according to 3004H191 of the Japanese Industrial Standards (JIS)) are covered with a polyester film having a same species and thickness as the one used in the first embodiment. Then, after the neck portion and the shoulder portion are formed on the bottom side of the in-process product at the top doming step, the opening portion is formed by cutting (or trimming) the leading end (top end) of the unopened neck portion formed at the top doming step. As can be seen from FIG. 11, first of all, an area above the inclined face 22 corresponds to the portion 21A to be curled as illustrated in (A). Prior to the threading step, the cylindrical opening portion is flanged outwardly over the length from the trim end portion 21*a* at the first step curling step, as illustrated in (B). Then, at the second step, the flanged portion is folded downwardly as illustrated in (C). Thus, the two-layered folded portion 21B is formed at the opening end portion.

Next, at the third step, the opening end portion on which the folded portion 21B is formed is flanged outwardly over the predetermined length, as shown in (D). Subsequently, at the fourth step, the flanged portion is refolded downwardly as shown in (E). As a result, the trim end portion 21*a* is rolled-in the folded portion 200 so that the curled portion 21 is formed into the final shape in which the metallic sheet is overlapped in three layers in the can radius direction. In the most part of this final shape, the metal sheet layers are in close contact with one another hermetically via the resin films in the can radius direction, except both upper and lower ends. Moreover, the lower end of the curled portion 21 is contacted with the lower inclined face 22 to form the contact portion 203.

According to the curled portion 21 of this embodiment (i.e., the second embodiment) thus formed as mentioned above, the trim end portion 21*a* is so rolled-in as to be confined inside of the folded portion 200, as the case previously described first embodiment. Therefore, the trim end portion 21*a* can be hidden completely. Also, the metal sheet layers are in close contact with one another hermetically via the resin films in the curled portion so that the external moisture is prevented from reaching the trim end portion 21*a* of the curled portion 21. Consequently, it is possible to prevent the trim end portion 21*a* from getting corroded. Moreover, the curled portion 21 is squeezed in the can radius direction, and the lower end portion of the curled portion 21 is contacted with the inclined face 22. Therefore, the curled portion 21 will not be deformed even when it is pressurized from above or it experiences a drop impact after being manufactured into a canned product. Additionally, the curled portion 21 does not cause springback so that its shape and dimensions will not be changed. Therefore, adequate sealability can be maintained stably between the sealing member 31 of the cap 30 and the curled portion 21.

Moreover, according to this embodiment (i.e., the second embodiment), the metal sheet is overlapped in three layers in the curled portion 21 and squeezed in the can radius direction. Therefore, the numbers forming steps of the curled portion reduced so that the manufacturing cost can be saved, in comparison with the case of forming the curled portion in which the metal sheet is overlapped in four layers in the can radius direction. Furthermore, the curled portion 21 is thin in its entirety in the can radius direction, and the top portion of the curled portion 21 and the vicinity thereof is comparatively thin in the can radius direction. Therefore, the top portion of the curled portion 21 can be sufficiently received in the sealing member 31 of the cap 30. As a result, the sealability can be enhanced between the sealing member 31 of the cap 30 and the curled portion 21.

In addition, the bottle-shaped can according to this embodiment can also be shaped from the steel sheet. In the viewpoint of improving the sealability by enhancing the roundness of the inner and outer faces of the curled portion, it is preferable to form the curled portion 21 after forming the threaded portion 23, also in the bottle-shaped can of this embodiment. Also, it is also possible to form the threaded portion after carrying out the curled portion forming steps halfway, and then carry out the rest of the curled portion forming steps. In consideration of preventing a buckling of the threaded portion at the curled portion forming time and improving the sealability between the curled portion and the seal member of the cap, it is preferable to carry out the threading step, e.g., between the steps (D) and (E) shown in FIG. 11. It is because the inner face side of the curled portion is formed into a shape corresponding to the shape of the outer face of the mandrel 16 at the final folding step (E) of the threading/curling step, and the roundness of both inner and outer face sides of the curled portion is improved.

Next, here will be described a third embodiment of the present invention. A main object of the third embodiment is to prevent the moisture more completely from penetrating into the curled portion of the curled configuration of the second embodiment, and to prevent the trim end portion completely from getting rusty.

Figure 12:
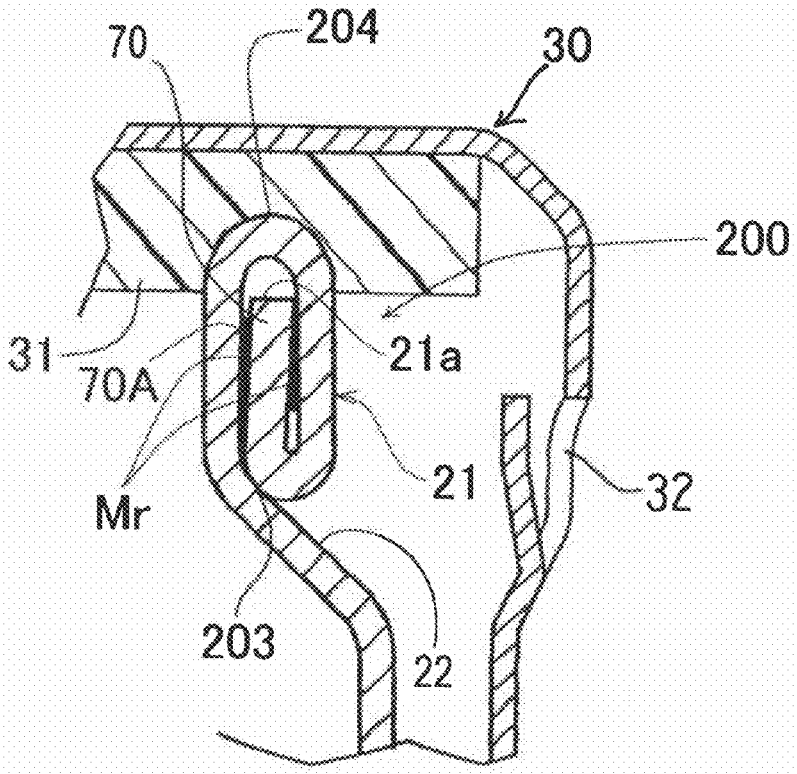
FIG. 12 is an enlarged partial sectional view showing a configuration of the curled portion folded into two layers and bonded by a fused resin, in which the cap is capped thereon.

In this embodiment, a surface-treated steel sheet such as, an electrolytic chromate treated steel sheet, a nickel-plated steel sheet, an extremely thin tin plated steel sheet or the like are used as making the can from the metal sheet. The method to be used in this embodiment: in which a cup is shaped by punching/drawing a surface-treated steel sheet wherein both faces are covered with the thermoplastic resins; in which the cup is then formed into a bottomed cylindrical in-process product (i.e., a deep cup) by re-drawing and ironing; and in which after this, a diametrically small neck portion and a inclined shoulder portion are formed at the top doming step; is disclosed in the aforementioned U.S. Pat. Nos. 6,463,776 and 6,499,329, therefore, an explanation of which is omitted. According to an outwardly curled portion, which is formed at the threading/curling step, and which is formed into an annular shape on an upper end opening edge of the cylindrical neck portion wherein both inner and outer faces being covered with thermoplastic resin films, the trim end portion 21*a* of the opening portion is rolled in and confined inside of the curled portion 21, and the curled portion 21 is squeezed in the can radius direction as shown in FIG. 12 so as to form, i.e., the folded portion 200. In the most part but except the vicinity of both upper and lower ends of the folded portion 200 of the curled portion 21, the metal sheet is overlapped in three layers in the can radius direction, and the metal sheet layers are in close contact with one another hermetically via the thermoplastic resin films. Moreover, the contact portion 203 is contacted with the inclined face 22 formed between portion 21A to be curled of the neck portion and the thread forming portion 202 by applying the mouth-drawing twice. Furthermore, the contact portions of the metal sheet layers are bonded mutually by the thermoplastic resin films Mr fused with each other.

According to this embodiment, all of the contact portions of the curled portion 21 between the layers of metal sheet overlapped in three layers in the can radius direction are thermally bonded with the fused thermoplastic resin films Mr. However, it is not necessary to bond all of the contact portions between the metal sheet layers. Namely, it is sufficient to bond at least a clearance 70A (i.e., a contact portion between the innermost metal sheet layer and the metal sheet layer contact thereto) between a first and a second metal sheet layers from the inner side of the can.

The aforementioned configuration of the curled portion of the bottle-shaped can according to this embodiment comprises the folded portion 200, in which the metal sheet is overlapped in three layers and the folded portion 200 is squeezed in the can radius direction. Moreover, the lower end of the folded portion 200 contacts with the inclined face 22. Therefore, the curled portion 21 will not be deformed seriously, even if it is pressurized from above by the capper when the cap is capped thereon, or even if it experiences a drop impact due to an accidental fall of a carton, after being manufactured into a canned product and packed therein. Moreover, a shape and dimensions of the curled portion 21 will not be changed due to the springback. Accordingly, adequate sealability can be maintained stably between the sealing member 31 of the cap 30 and the curled portion 21.

Moreover, the curled portion 21 is squeezed so that it is thin in its entirety in the can radius direction. Therefore, the top portion 204 of the curled portion 21 is received in (cut in) the surface of the sealing member 31, when the sealing member 31 of the cap 30 is pressurized from above by the capper, and contacted with the top portion 204 of the curled portion 21 by the cap 30 being capped thereon. As a result, the sealability can be improved between the seal member 31 of the cap 30 and the curled portion 21.

Furthermore, since the trim end portion 21*a* is rolled in and confined inside of the curled portion 21, even if the resin film is separated and fluffed hair like strings in the manufacturing process (i.e., when the leading end (top end) of the unopened neck portion 2 is trimmed to be opened), and the trim end portion 21*a* of the opening portion and vicinity thereof gets visually undesirable, such esthetically undesirable hair like strings can be completely hidden. Moreover, in the curled portion 21, the metal sheet layers are folded in such manner that the layers are in close contact with one another hermetically via the resin film 71, and the contact portion between the metal sheet layers is thermally bonded by the fused thermoplastic resin films Mr. Therefore, it is possible to certainly prevent the external moisture from reaching the trim end portion 21*a* confined inside of the curled portion 21, even if the moisture enters from vent slits 32 of the cap 30. As a result, in case the metal can is a steel can, the trim end portion 21*a* can be prevented certainly from getting rusty.

Figure 13:
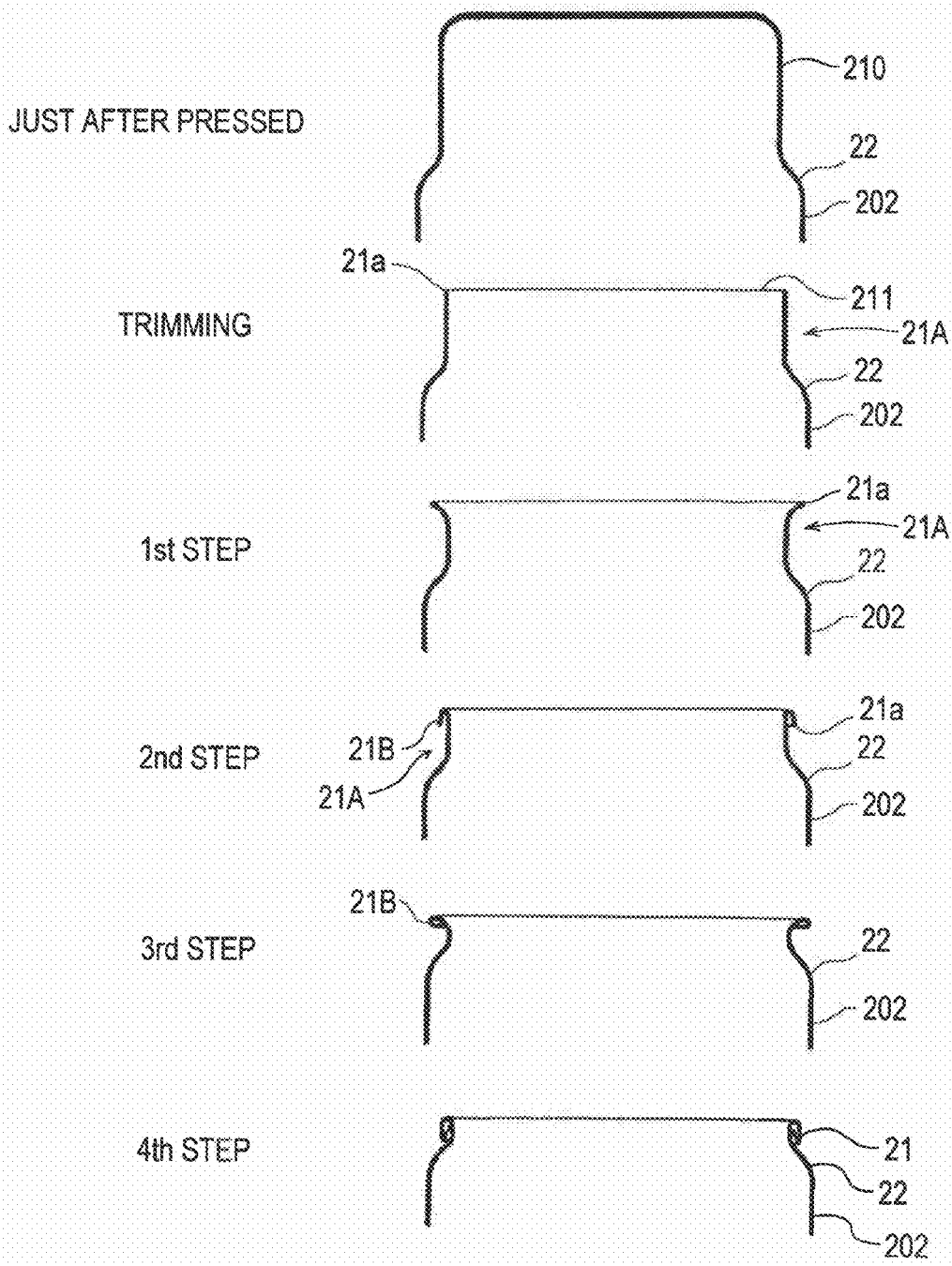
FIG. 13 is an explanatory drawing showing sections of the can at individual steps for forming the curled portion folded into three layers on the opening portion (i.e., the upper end portion of the neck portion) of the bottle-shaped can.

The aforementioned forming method of the curled portion 21 according to this embodiment will be further described hereinafter. As shown in FIG. 13, the leading end (top end) of the unopened (just after pressed) neck portion 210 formed at the top doming step is cut (or trimmed) to open the neck portion 210 at the threading/curling step, so as to form the opening portion 211. Then, at a first step of the curling step prior to the threading step, a the cylindrical opening portion is flanged outwardly over the predetermined length from the trim end portion 21*a*, and at a second step, the cylindrical opening portion flanged over the predetermined length from the trim end portion 21*a* is folded downwardly into two folds. At the third step, the two-layered folded portion is flanged outwardly, and at the fourth step, the flanged folded portion is refolded downwardly. Thus, the outwardly curled portion 21, in which the metal sheet is squeezed in the can radius direction and overlapped in three layers, is formed into the annular shape on the opening end portion.

Figure 11:
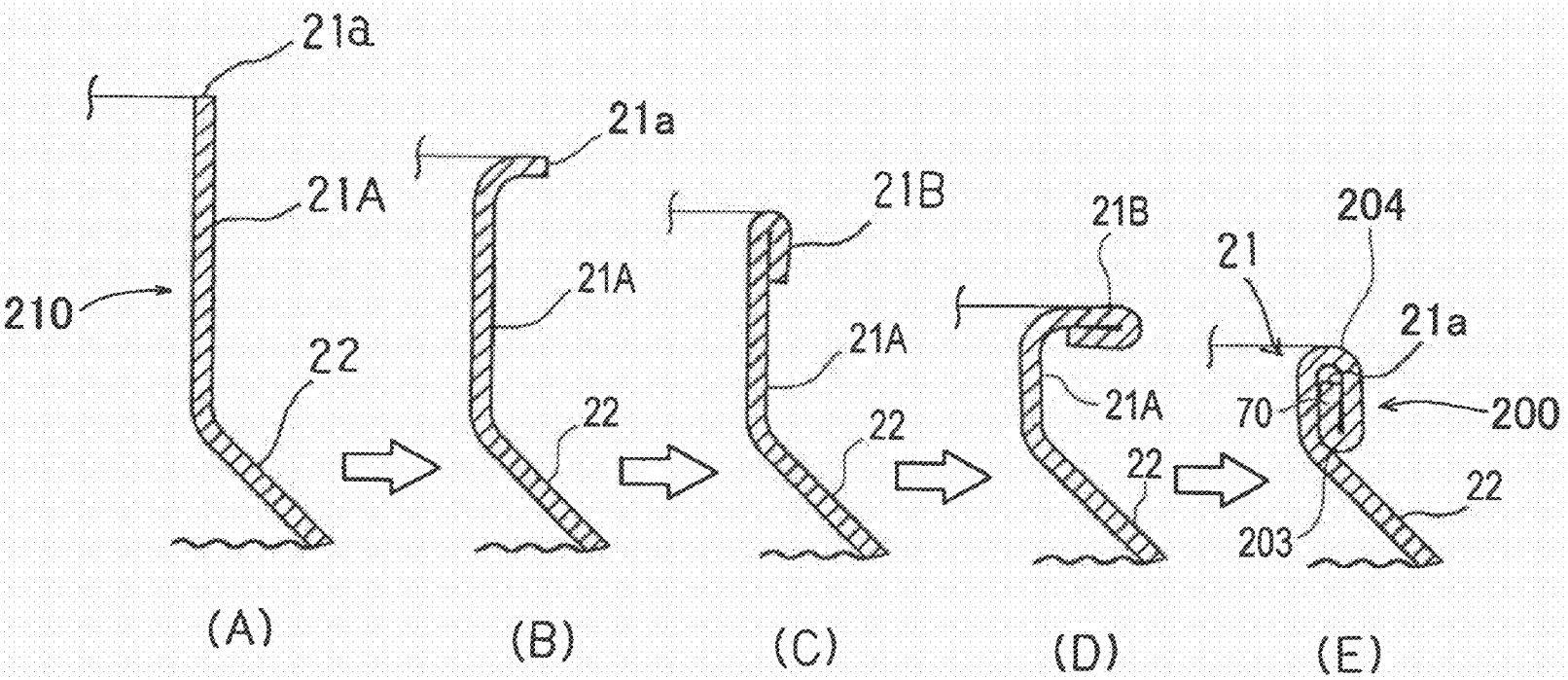
FIG. 11 is an explanatory drawing sequentially showing enlarged sections of the curled portion shown in FIG. 10 at individual processing steps.

Specifically, as shown in previously cited FIG. 11, in the state of (A), the neck portion is cut (or trimmed) to be opened and the area above the inclined face 22 is the portion 21A to be curled. At the first step, the flange is formed as illustrated in (B). At the second step, the flanged portion is folded to form the two-layered folded portion 21B at opening end portion, as illustrated in (C). Then, the folded portion 21B is flanged at the third step as illustrated in (D), and refolded at the fourth step as illustrated in (E), thereby to form the curled portion 21 squeezed in the can radius direction. The folded portion 200 thus formed, i.e., the curled portion 21 contacts with the inclined face 22 at the contact portion 203 of its lower end portion, and in the most part but except both upper and lower end portions of the curled portion 21, the metal sheet is overlapped in three layers and the layers are in close contact with one another hermetically via the resin films in the can radius direction.

Here, in the aforementioned method of forming/processing the curled portion 21 according to this embodiment, the forming tool shown in above cited FIG. 8 can be used when flanging the two-layered folded portion 21B outwardly at the third step. Specifically, as shown in FIG. 8, the disc-shaped spinning die 10 (i.e., a rotational flanging head) is used. The rotation axis of the spinning die 10 is inclined at a predetermined angle θ (0.5 to 8.0 degree, preferably 1.0 to 5.0 degree) in relation to the axial direction of the can 1. The opening portion of the can 1 is flanged sequentially part by part in the circumferential direction by applying the pressure of the spinning die 10 from above while rotating the can 1 and the spinning die 10 in the same direction, and keeping a portion of an outer circumferential working face 10*a* of the spinning die 10 in substantial line contact with the opening portion of the can from inside.

Specifically, both the can 1 and the spinning die 10 are rotated in the same direction by holding any one of a shaft member 11 for fixedly holding the spinning die 10 and a mandrel 12 for holding the can 1 detachably in the rotatable condition and driving the other one, or by driving both of them. In this case, the rotation axis of the spinning die 10 is inclined at a slight angle θ in relation to the axial direction of the can 1, therefore, the working face 10*a*, which is formed on the lower end outer circumference of the disc-shaped spinning die 10, and extended in the circumferential direction, is contacted obliquely with the upper end opening portion of the can 1 from inside. As a result, the outer circumferential working face 10*a* of the disc-shaped spinning die 10 is brought into contact internally with the opening portion of the can 1 in the state of partial line contact (i.e., extremely narrow arcuate surface contact). In this state, the two-layered folded portion formed on the opening portion of the can 1 is flanged sequentially part by part in the circumferential direction by applying the pressure from above by the spinning die 10.

At the fourth step, when further folding the flanged folded portion 21B downwardly, e.g., the forming tool shown in the above cited FIG. 9 can be used. Specifically, the annular internal roller 13 (i.e., a folding roller) is used, which moves in the direction perpendicular to the axial direction of the can 1. The opening portion of the can 1 is flanged sequentially part by part in the circumferential direction by applying the pressure from the side by the internal roller 13 held rotatably, while rotating the can 1 relatively and keeping a portion of an inner circumferential working face 13*a* of the internal roller 13 in the circumferential direction in substantial line contact from outside with the opening portion of the can 1.

Specifically, the annular internal roller 13 is held rotatably by the frame member 15 through the bearing 14. On the other hand, the rotary drive shaft 17 penetrating a center space of the internal roller 13 is connected with the mandrel 16 for holding the can 1 detachably. The can 1 is rotated through the mandrel 16 by driving the rotary drive shaft 17, and the internal roller 13 is moved horizontally (i.e., in the direction perpendicular to the axial direction of the can 1) by moving the frame member 15 horizontally. As a result of this, the working face 13*a*, which is formed at the lower end inner circumference of the internal roller 13 and extended in the circumferential direction, is contacted from outside with the opening outer end of the can 1. Thus, the flanged two-layered folded portion 21B is folded downwardly and sequentially part by part in the circumferential direction by applying the pressure from the side by the internal roller 13, while keeping the opening portion of the can 1 in partial line contact (i.e., extremely narrow arcuate surface contact) with the inner circumferential working face 13*a* of the internal roller 13.

According to the flanging and the folding by the aforementioned concrete measures (means), the opening portion can be processed little by little by processing sequentially part by part in the circumferential direction, while keeping the forming tools (i.e., the spinning die 10 and the internal roller 13) in partial line contact with the opening portion of the can 1. Accordingly, it is not necessary to raise the pressure (i.e., the suppressing strength) to be applied by the forming tools that much, even when processing the aforementioned folded portion 21B which is folded into two folds and difficult to be elongated and contracted in the circumferential direction. As a result, it is possible to prevent the damage caused by the contact of the forming tools on the resin film covering the inner face side of the opening portion of the can.

According to the method of this embodiment, a local heat treatment is further applied to the curled portion 21 formed by the aforementioned flanging and folding. By this heat treatment, the thermoplastic resin films interposed between the contact portion of the metal sheet layers are soften (i.e., in a state where the thermoplastic resin films are heated to higher than the thermoplastic resin film's stickiness starting temperature and softened) or molten at the contact portion between the metal sheet layers overlapped in three layers in the can radius direction of the curled portion 21, so that the thermoplastic resin films of the contacting layers are fused with each other. As a result, the metal sheet layers are thermally bonded together through the resin films. In addition, after the curled portion 21 is formed, it is heated to a temperature at which the thermoplastic resin films are softened or molten. Therefore, even if the thermoplastic resin films, which are formed on the outer face of the curled portion 21 to be contacted with the forming tool, gets scratched (i.e., a streak of recess, or a fray) little bit when the curled portion 21 is formed, such scratch is recovered and smoothened as a result of the heat treatment. Therefore, when the consumer drinks the beverage filled in the can directly from the can, he or she will not feel an uncomfortable feeling due to a surface roughness of the curled portion 21. This is a secondary effect obtained by the present invention.

Figure 14A:
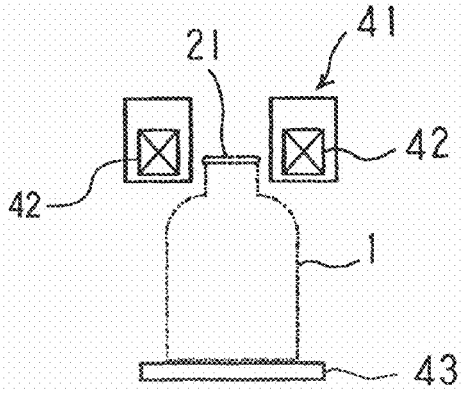
FIG. 14A is an explanatory front view showing an arrangement of a heating apparatus for locally heating a formed curled portion.
Figure 14B:
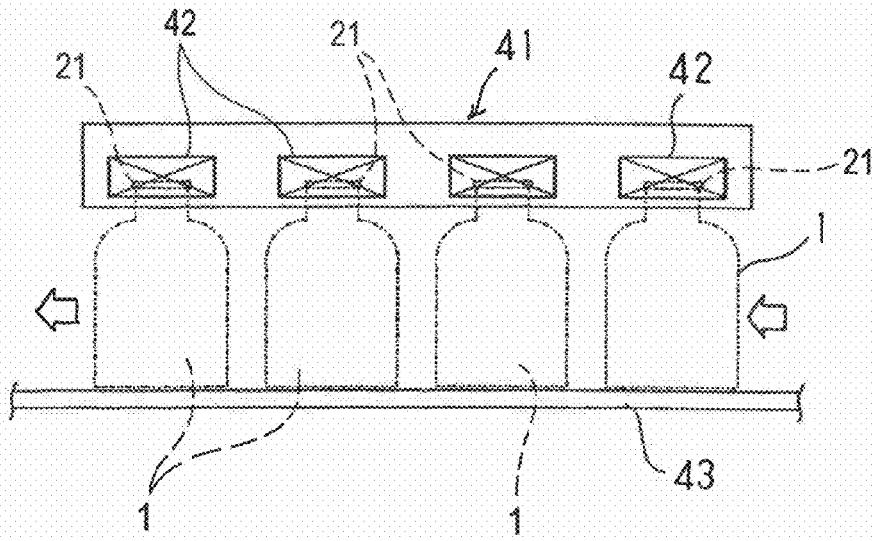
FIG. 14B an explanatory side view showing the arrangement of the heating apparatus.

The concrete measure for applying the heat treatment to the formed curled portion 21 should not be limited to any specific means. For example, in case of employing heat treatment means based on a high-frequency induction-heating method using an induction-heating coil, as shown in FIGS. 14A and 14B, it is sufficient to provide a simple heating device 41. In the heating device 41, an induction-heating coil 42 is simply arranged at a proper place along a transfer route 43 at around a level of the curled portion 21 of the can 1 transmitted consecutively along the transfer route 43. According to this construction, the heat treatment for raising the temperature of the metal sheet forming the curled portion 21 of the individual can 1 to an appropriate temperature can be easily applied without rotating individual can 1 but by just controlling an electric current of the induction-heating coil 42 while transporting the can 1.

Here will be further described such heat treatment of the curled portion 21. After forming the curled portion 21, the neck portion including the curled portion 21 is heated to the temperature around a fusing point of the resin films of the thermoplastic resin or higher prior to forming the thread on the lower portion, in order to soften or melt the thermoplastic resin at the contact portion between the metal sheet layers in the curled portion 21. As a result of this, the softened or molten thermoplastic resin films on the contacting layers are fused together. After this, the curled portion 21 is quenched immediately so as to put the thermoplastic resin films on the neck portion including the curled portion 21 into an amorphous state by blowing a cold blast (below 20 degree C., preferably below 15 degree C.) etc. This is advantageous to form the thread or the like subsequently.

Here, in the above mentioned embodiment, all of the contact portions between the metal sheet layers are thermally bonded through the fused thermoplastic resin films inside of the curled portion 21 in which the metal sheet is overlapped in three layers in the can radius direction, by the heat treatment based on the high-frequency induction-heating method or the like. However, according to the method of the present invention, it is not necessarily to bond all of the contact portions via thermoplastic resin films between the metal sheet layers. Specifically, as has been described in the description of the configuration of the curled portion 21, it is sufficient to thermally bond only the clearance between the innermost metal sheet layer and the second metal sheet layer counting from the can trunk side (i.e., the contact portion between the innermost metal sheet and the metal sheet contacting thereto) by fusing the thermoplastic resin films.

According to the aforementioned method of this embodiment of applying the heat treatment to the curled portion 21, the contact portion between the metal sheet layers can be bonded through (via) the thermoplastic resins only by heating the formed curled portion 21 locally by appropriate heating means (e.g., high-frequency induction-heating, far-infrared radiation, near-infrared radiation, hot blast, etc.). According to the method of the invention, therefore, the contact portions via thermoplastic resin films between the metal sheet layers in the curled portion 21 can be thermally bonded by proper and simple means much easier, in comparison with the case of e.g., applying a thermosetting resin or attaching a molten thermoplastic resin material to the contact portion between the inclined face and a closed portion of the lower end of the curled portion having a generally arcuate cross-section, or a case of fusing the resin films by irradiating with a laser. In view of the sealability, it is preferable to form the threaded portion before the curled portion is finished also in this embodiment, as the case of another embodiment.

Although the invention has been described in connection with one embodiment of the curled portion of the metal can and manufacturing method thereof, it should not be limited to the aforementioned embodiments. For example, according to the aforementioned embodiments, the metal sheet is overlapped in three layers in the can radius direction of the curled portion, by folding the opening portion over the predetermined length from the trim end portion outwardly, and then applying the flanging and the folding one time respectively. However, the metal sheet may be overlapped in four layers in the can radius direction of the curled portion by applying the flanging and the folding for curling twice respectively, and the contact portions between the metal sheet layers may be thermally bonded through the thermoplastic resin films by applying the heating treatment subsequently.

Figure 15:
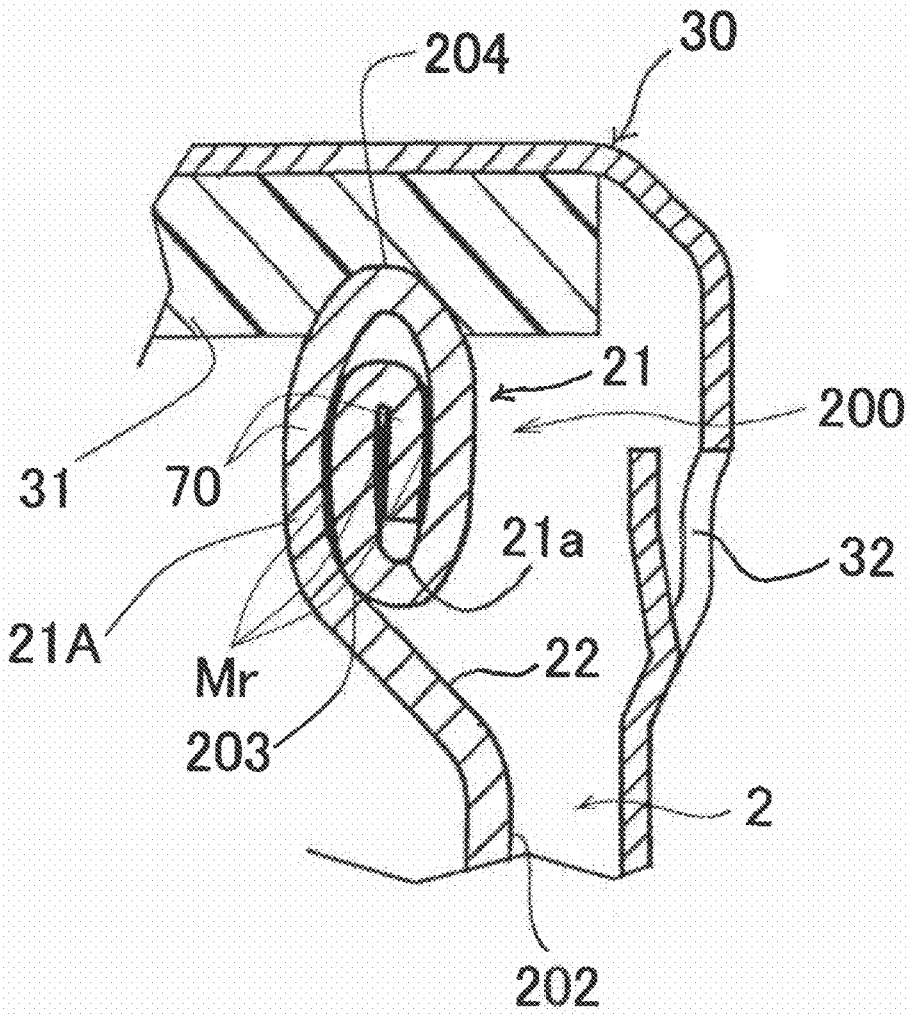
FIG. 15 is an enlarged partial sectional view showing a configuration of the curled portion folded into four layers and bonded by the fused resin, in which the cap is capped thereon.

In the so-called "four-layered" curled portion 21, as illustrated in FIG. 15, the metal sheet 70 is overlapped in four layers in the can radius direction in the most part but except both upper and lower ends of the curled portion, and the layers are in close contact with one another hermetically via the resin films Mr which are solidified after molten or softened. Moreover, the lower end of the curled portion 21 is contacted with the lower inclined face 22, and the curled portion 21 is tapered in the vicinity of the top portion toward the top portion 204. Furthermore, the contact portion between the metal sheet layers overlapped in the can radius direction is bonded through the fused thermoplastic resin films.

Here, also in the four-layered curled portion 21, it is sufficient to thermally bond only the clearance between the innermost metal sheet layer and the second metal sheet layer, and it is not necessary to bond all of the contact portions via thermoplastic resin films between the metal sheet layers. Besides, in case of four-layered metal sheet, it is also sufficient to thermally bond only the contact portion via thermoplastic resin films between the outermost metal sheet and the metal sheet contacted thereto.

The forming/processing of the four-layered curled portion may be carried out by the same procedure shown in FIG. 5. Specifically, as shown in FIG. 5, in the state of (A), the leading end (top end) of the neck portion 210 is trimmed to be opened and an area above the inclined face 22 corresponds to the portion 21A to be curled, as the case of forming the three-layered curled portion. At the first step, the flange is formed as shown in (B). At the second step, the flanged portion is folded as shown in (C), and a two-layered folded portion 21B is formed on the opening end portion. Then, at the third step, the two-layered folded portion 21B is flanged as shown in (D). At the fourth step, the two-layered folded portion 21B is folded as shown in (E), and the three-layered curled portion 21C is formed on the opening end portion. Moreover, at the fifth step, the three-layered curled portion 21C is further flanged as shown in (F). Then, through the state shown in (G), at the sixth step, the curled portion 21 is refolded as shown in (H) so as to have the final four-layered configuration which is squeezed in its entirety in the can radius direction. The heat treatment is further applied locally to the curled portion 21 thus formed to have the four-layered configuration, similarly to case-of three layered curled portion.

The metal can having a three-layered or four-layered curled portion, to which the invention is applied, should not be limited to the type of the bottle-shaped can described in individual embodiments thus far described. Specifically, the invention may also be applied to a type of bottle-shaped can different from the one described in the above-mentioned embodiments. For example, a several types of bottle-shaped can disclosed in detail in the specification of the aforementioned U.S. Pat. No. 5,718,352 may also be used, such as: the bottle-shaped can, wherein a separated can end having a neck portion and a shoulder portion is fixed by a double-seaming method to an upper end opening of a can body, which is formed by a known deep-drawing or drawing/ironing (i.e., a drawn and re-drawn can, and DI can) integrally with a can trunk and a can bottom; or a bottle-shaped can, in which a neck portion and a shoulder portion are formed (the shoulder portion may be a smooth neck) by applying a plurality of steps of necking-in to an upper end opening side of a can body formed integrally with the can trunk and the can bottom.

Figure 16:
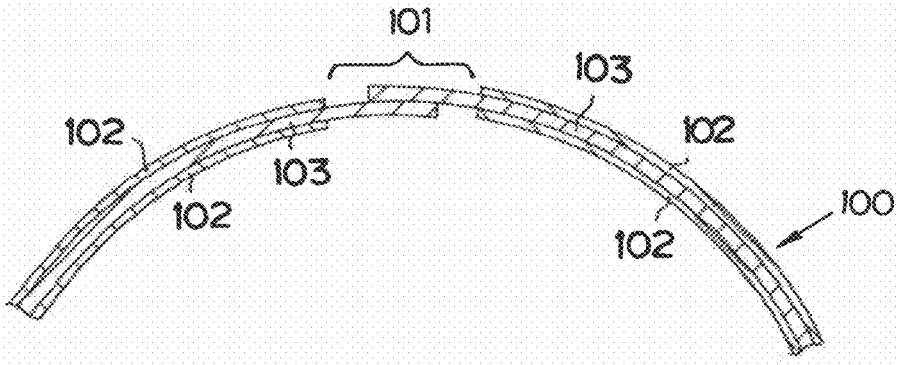
FIG. 16 is a partial sectional view showing a welded can trunk in the state where before a welding is not completed.

Further, the metal can to which the invention is applied, should not be limited to the bottle-shaped can, but the invention may also be applied to a wide-mouthed type threaded can, in which a threaded mouth portion is formed on an upper end opening portion a necked-in DI can. Moreover, the metal can to which the invention is applied, should not be limited to a seamless can (i.e., a can does not have a seam joint on its trunk portion in vertical direction), but the invention may also be applied to an appropriate type of bottle-shaped can using a welded can body, or to a wide-mouthed type threaded can (including a threaded can having a welded seam joint portion on the curled portion). As shown in FIG. 16, the welded can body 100 is formed by shaping a resin coated steel sheet 103 in which both faces are covered with resin films 102 except an estimated welding portion 101 into a cylindrical shape, then, welding the overlapping estimated welding portion 101, and forming resin films (not shown) thereon. After this, one of the end portion side of the welded can body 100 is formed into an inclined shoulder portion and a cylindrical neck portion leading thereto, and an outwardly curled portion is formed on the leading end portion of the neck portion while forming a threaded portion on the peripheral wall of the neck portion. The welded can body 100 is thus formed into the bottle-shaped can. According to the present invention, in short, the type of the metal can, to which the invention is applied, can be arbitrarily changed within the range of the metal can, in which the outwardly curled portion is formed on the opening portion. Besides, the material of the metal can, to which the invention is applied, should not be limited to steel as described in the above embodiments. An aluminum sheet, or an aluminum alloy sheet may also be used.

In the curled portion of the metal can according to the invention thus has been described, even if the trim end portion of the opening portion is visually undesirable due to hair like strings of the resin or the like, this can be completely hidden. Also, it is possible to prevent the external moisture from reaching the trim end portion. Accordingly, the trim end portion can be certainly prevented from getting rusty even in case of the steel can. Moreover, the curled portion will not be deformed by the pressure from above or the drop impact, and the shape and the dimensions of the curled portion will not be changed due to the springback. Therefore, adequate sealability can be maintained stably between the sealing member of the cap and the curled portion. Furthermore, the sealability can be enhanced between the sealing member of the cap and the curled portion by cutting the top portion of the curled portion into the sealing member of the cap when mounting the cap thereon.

Moreover, in the curled portion of the metal can according to of the invention, the metal sheet layers overlapped in three or four layers via the thermoplastic resin films in the can radius direction of the curled portion, are thermally bonded by softening or fusing the resin films formed on the surface of the metal sheet. Therefore, the penetration of the external moisture into the curled portion can be completely prevented, and the rusting on the trim end portion can be completely prevented even in case of the steel can.

According to the curled portion configuration of the invention, moreover, the method of thermally bonding the contact portion of the thermoplastic resin films each other can be carried out by a simple facility.

According to the curled portion forming method of the invention, moreover, the processing portion, which is folded into multiple layers can be processed without raising the force to be applied by the forming tool, when forming the outwardly curled portion by folding the cylindrical opening portion into two folds over the predetermined length from the trim end portion, and then curling the trim end portion. As a result of this, it is possible to prevent the damage caused by the contact with the forming tool on the resin film covering the inner face side of the opening portion of the can during the forming of the curled portion.

INDUSTRIAL APPLICABILITY

The present invention can be utilized in an industry relates to manufacture of the container comprising a resealability such as the bottle-shaped can, and to the products using this kind of container.

The invention claimed is:

1. A method for forming an outwardly curled portion of a metal can formed from a metal sheet having a resin film at least on an inner face, comprising:

flanging and folding a predetermined length of a trimmed opening portion of the metal can outwardly to form a folded portion comprising two layers of the metal sheet;

flanging the folded portion sequentially part by part in the circumferential direction, using a disc-shaped spinning die having a rotating shaft inclined with respect to an axial direction of the can, by applying a pressure from above by the spinning die, while rotating the can and the spinning die in the same direction and keeping a portion of an outer circumference of a working face of the spinning die in substantial line contact with the opening of the can along an inside surface of the can to form a flanged portion; and folding the flanged portion downwardly by sequentially folding the flanged portion part by part in the circumferential direction by applying a sideways pressure by an annular internal roller which moves in the direction perpendicular to the axial direction of the can, while keeping the annular internal roller in a substantially linear contact from outside with the opening portion of the rotating can to form a refolded portion comprising three layers of the metal sheet in which adjacent surfaces of the three layers of the metal sheet are closely contacted with one another via the resin film except for upper and lower ends of the refolded portion.

2. The method according to claim 1, further comprising:

further flanging and folding the refolded portion to form a second refolded portion comprising four layers of the metal sheet; and squeezing the second refolded portion in its entirety in the can radius direction to bring into contact adjacent surfaces of the four layers of metal sheet closely with one another via the resin film except for upper and lower ends of the second refolded portion.

3. The method according to claim 2, wherein the metal can is a bottle-shaped can, the method further comprising:

integrally shaping a neck portion, a shoulder portion and a trunk portion from the metal sheet, wherein both surfaces of the metal sheet are laminated with thermoplastic resin films, and the folded portion is formed at an upper end of the neck portion; and threading a peripheral wall of the neck portion.

4. The method according to claim 3, wherein the threading the periphery wall is performed after the squeezing the second refolded portion.

5. The method according to claim 3, wherein the threading the periphery wall is performed prior to the flanging and folding the predetermined length of the trimmed opening portion of the metal can.

6. The method according to claim 3, wherein the threading the periphery wall is performed between the further flanging and folding the refolded portion to form the second refolded portion comprising four layers of the metal sheet, and the squeezing the second refolded portion in the can radius direction.

7. The method according to claim 1, wherein the metal can is a bottle-shaped can, the method further comprising:

integrally shaping a neck portion, a shoulder portion and a trunk portion from the metal sheet, wherein both surfaces of the metal sheet are laminated with thermoplastic resin films, and the refolded portion is formed at an upper end of the neck portion; and threading a peripheral wall of the neck portion.

8. The method according to claim 7, wherein the threading the periphery wall is performed after squeezing the refolded portion.

9. The method according to claim 7, wherein the threading the periphery wall is performed prior to the flanging and folding the predetermined length of the trimmed opening portion of the can.

10. The method according to claim 7, wherein the threading the periphery wall is performed between flanging the folded portion and squeezing the refolded portion.

11. The method according to claim 1, wherein the metal sheet comprises an aluminum alloy sheet.

12. The method according to claim 1, wherein the metal sheet comprises a steel sheet.

13. A method for forming an outwardly curled portion of a metal can shaped from a metal sheet having thermoplastic resin films on both surfaces of the metal sheet, the method comprising:

flanging and folding a predetermined length of a trimmed opening portion of the metal can outwardly to form a folded portion comprising two layers of the metal sheet;

flanging the folded portion sequentially part by part in the circumferential direction, using a disc-shaped spinning die having a rotating shaft inclined with respect to an axial direction of the can, by applying a pressure from above by the spinning die, while rotating the can and the spinning die in a same direction and keeping a portion of an outer circumference of a working face of the spinning die in substantially linear contact with the opening of the can along an inside surface of the can to form a flanged portion;

refolding the flanged portion downwardly by sequentially folding the flanged portion part by part in the circumferential direction by applying a sideways pressure by an annular internal roller which moves in the direction perpendicular to the axial direction of the can, while keeping the annular internal roller in a substantially linear contact from an outside portion thereof with an opening portion of the rotating can, to form a refolded portion comprising three layers of the metal sheet, so that metal sheet layers forming the refolded portion are arranged in close contact with one another via the resin films except for upper and lower ends of the refolded portion; and thermally bonding the metal sheet layers in close contact with one another via the resin films by heating the can to fuse the resin films.

14. The method according to claim 13, further comprising:

further flanging and folding the refolded portion to form a second refolded portion comprising four layers of the metal sheet; and squeezing the refolded portion in its entirety in the can radius direction to contact adjacent surfaces of the four layers of the metal sheet closely with one another via the resin films except for upper and lower ends of the folded portion, wherein the thermally bonding the metal sheet layers is performed after the squeezing.

15. The method according to claim 14, wherein the metal can is a bottle-shaped can, the method further comprising:

integrally shaping a neck portion, a shoulder portion and a trunk portion from the metal sheet, wherein the folded portion is formed at an upper end of the neck portion; and threading a peripheral wall of the neck portion prior to performing the squeezing.

16. The method according to claim 13, wherein the thermally bonding the metal sheet layers includes locally thermally bonding a clearance between an inner most metal sheet layer and a next metal sheet layer.

17. A method for forming an outwardly curled portion of a bottle-shaped metal can formed from a metal sheet, the method comprising:

integrally shaping a neck portion, a shoulder portion, and a trunk portion from the metal sheet, wherein both surfaces of the metal sheet are laminated with a thermoplastic resin film;

flanging and folding a predetermined length of a trimmed opening portion of the metal can outwardly to form a folded portion at an upper end of the neck portion, the folded portion comprising two layers of the metal sheet;

flanging the folded portion sequentially part by part in the circumferential direction, using a disc-shaped spinning die having a rotating shaft inclined with respect to an axial direction of the can, by applying a pressure from above by the spinning die, while rotating the can and the spinning die in the same direction and keeping a portion of an outer circumference of a working face of the spinning die in substantial line contact with the opening of the can along an inside surface of the can to form a flanged portion;

folding the flanged portion downwardly by sequentially folding the flanged portion part by part in the circumferential direction by applying a sideways pressure by an annular internal roller which moves in the direction perpendicular to the axial direction of the can, while keeping the annular internal roller in substantial line contact from outside with the opening portion of the rotating can to form a refolded portion comprising three layers of the metal sheet;

further flanging and folding the refolded portion to form a second refolded portion comprising four layers of the metal sheet;

threading a periphery wall of the neck portion after carrying out the further flanging and folding; and squeezing, after the threading, the second refolded portion in its entirety in the can radius direction to bring into contact adjacent surfaces of the four layers of the metal sheet closely with one another via the resin film except for upper and lower ends of the second refolded portion.

* * * * *